US007865997B2

(12) United States Patent
Fuchigami et al.

(10) Patent No.: US 7,865,997 B2
(45) **Date of Patent: *Jan. 11, 2011**

(54) DRY TYPE CLEANING APPARATUS AND DRY TYPE CLEANING METHOD

(75) Inventors: Akihiro Fuchigami, Kanagawa (JP); Yoichi Okamoto, Kanagawa (JP); Tatsuya Satoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 219 days.

This patent is subject to a terminal disclaimer.

(21) Appl. No.: 11/589,928

(22) Filed: Oct. 31, 2006

(65) Prior Publication Data

US 2007/0107752 A1 May 17, 2007

(30) Foreign Application Priority Data

Nov. 2, 2005 (JP) ..... 2005-319204
Sep. 25, 2006 (JP) ..... 2006-258191

(51) Int. Cl.
*A47L 5/14* (2006.01)

(52) U.S. Cl. ..... 15/345; 15/347; 15/363

(58) Field of Classification Search ..... 15/303, 15/306.1, 309.2, 345, 346, 56
See application file for complete search history.

(56) References Cited

U.S. PATENT DOCUMENTS 5,018,318 A * 5/1991 Hunziker ..... 451/80
5,107,632 A * 4/1992 Stern et al. ..... 451/88
5,351,354 A * 10/1994 Hasumi et al. ..... 15/1.51
6,358,328 B1 * 3/2002 Yang et al. ..... 134/21
6,493,529 B1 12/2002 Umemura et al.
7,024,147 B2 4/2006 Sugawara et al.
2003/0115710 A1 * 6/2003 Choi ..... 15/309.2
2005/0107017 A1 * 5/2005 Fioratti ..... 451/526
2006/0014021 A1 1/2006 Sugawara et al.
2009/0097892 A1 4/2009 Murakami et al.

FOREIGN PATENT DOCUMENTS

| | | | |
|---|---|---|---|
| EP | 0-649-705 | | 4/1995 |
| JP | 63-103787 | | 7/1988 |
| JP | 63-224783 | | 9/1988 |
| JP | 4-83567 A | | 3/1992 |
| JP | 04-256477 | | 9/1992 |
| JP | 06-182305 | * | 7/1994 |
| JP | 06-254522 | * | 9/1994 |
| JP | 3288462 | | 9/1994 |
| JP | 2791862 | | 5/1996 |
| JP | 2643103 | | 5/1997 |
| JP | 3604961 | | 1/2001 |
| JP | 2002-028581 | | 1/2002 |
| JP | 2003-122123 | | 4/2003 |
| JP | 2003-190247 | * | 7/2003 |
| JP | 2005-329292 | * | 12/2005 |

* cited by examiner

*Primary Examiner*—Michael Kornakov
*Assistant Examiner*—Natasha Campbell
(74) *Attorney, Agent, or Firm*—Dickstein Shapiro LLP

(57) ABSTRACT

A dry type cleaning technology is disclosed. Dust adhering to a cleaning object is removed with a cleaning medium caused to flow by a high-speed airflow. The removed dust is separated from the cleaning medium with a porous member including holes through which air, dust, and granular material can pass but the cleaning medium cannot pass. An area on the porous member where air is received to cause the cleaning medium to flow and an area on the porous member where air is received to suction the dust separated from the cleaning medium are switched.

6 Claims, 17 Drawing Sheets

DRY TYPE CLEANING APPARATUS AND DRY TYPE CLEANING METHOD

BACKGROUND OF THE INVENTION

1. Field of the Invention

The present invention relates generally to dry type cleaning apparatuses and dry type cleaning methods for removing, by using solid cleaning media and without using water or solvents, dust and granular material, e.g., toner having average granular diameters of 5 μm through 10 μm. The toner is used in electrophotographic image forming apparatuses such as copiers and laser printers, where it adheres to various cleaning objects such as components having relatively complex shapes. More particularly, the present invention relates to a dry type cleaning apparatus and a dry type cleaning method with which cleaning objects can be continuously loaded and cleaned, thereby enhancing operability.

2. Description of the Related Art

Manufacturers of office equipment such as copiers, facsimile machines, and printers are actively involved in recycling activities for the purpose of realizing a resource-recycling society. Specifically, the manufactures recover used products and units from users, and disassemble, clean, and reassemble the used products to be reused as components or resin material. In order to reuse components of these products and units, toner particles adhering to disassembled components and units need to be removed and cleaned off. Thus, reduction of cleaning costs and environmental impact is a major issue.

Patent Documents 1, 2 disclose wet type cleaning apparatuses that use water and solvents for removing dirt such as toner adhering to the components and units. The cleaning apparatus disclosed in Patent Document 1 includes a mesh cleaning basket with a large aperture. A cleaning object is fixed inside the cleaning basket, and the cleaning basket is conveyed by a conveying unit such as a belt conveyer along a path on which a cleaning solvent such as cleaning jet water is sprayed. The cleaning solvent is sprayed from above and from the sides of the cleaning basket being conveyed on the path. The cleaning solvent passes through the aperture and meshes of the cleaning basket, and collides with the cleaning object to clean the cleaning object. Cleaning baskets containing cleaning objects fixed inside are continuously loaded into the conveying unit, so that plural cleaning objects are continuously cleaned.

In the cleaning apparatus disclosed in Patent Document 2, multiple granular materials such as gel, gel foam, glass, ceramics, and synthetic resin are fluidized in a cleaning tank by gas flows. Liquid such as water and silicon liquid, which have the same relative density as the granular materials, is supplied in the cleaning tank. The supplied liquid is dispersed within granular fluid layers, thereby forming solid-liquid aggregates of appropriate sizes. Accordingly, the effective gas passage area is decreased so as to increase the gas flow velocity passing through the granular layers. This generates a peculiar three-phase stream in which fluidization of granular layers is activated, and the peculiar three-phase stream is caused to collide with the cleaning object so as to enhance cleaning efficiency.

When this wet type cleaning apparatus is used for cleaning off dirt such as toner adhering to components and units, it is necessary to perform processes such as disposing of waste water including toner and drying the components after being cleaned. These processes consume large amounts of energy and have high environmental impact.

A dry type cleaning method employing air-blowing is insufficient for cleaning off toner having a high level of adhesion strength. Thus, an after-treatment is required to manually wipe off the remaining toner. Accordingly, cleaning is a bottleneck process in reusing/recycling products.

Patent Document 3 discloses a dry type cleaning apparatus that removes dust adhering to a cleaning object as follows. A rotatable container is rotated, which container contains plural cleaning objects to which dust is adhering in an electrostatic manner, and spherical or cubic contact members made of an elastic material such as flexible urethane foam. While the container is being rotated, positive/negative aero-ions necessary for neutralizing electrical charges of the cleaning objects inside the container are emitted by ignition electrodes, and the aero-ions are sprayed onto the cleaning objects. The rotatable container is a cylinder, and the cleaning objects and the contact members are inserted into the rotating cylinder from an inlet part provided on one end of the cylinder. After the cleaning objects and the contact members are moved from an upstream side to a downstream side, the cleaning objects and the contact members are retrieved separately. Cleaning objects are continuously cleaned in the above manner.

Patent Document 4 discloses a dry type cleaning apparatus including a cleaning tank with a wire-mesh inner board for mounting a cleaning object. In between the inner board and the bottom of the cleaning tank there is provided a gas blowout section. Spherical granules having diameters of 5 mm to 10 mm made of steel, alumina, ceramics, plastic, etc., are placed in the gas blowout section. The gas blowout section has an aperture through which gas can pass but the granules cannot pass. Air from the cleaning tank is introduced through an inlet provided on a top lid, and external air is taken in from an inlet provided on the bottom of the cleaning tank, thereby forming a gas flow in the cleaning tank. The gas flow incorporates the granules into jet flows, and the jet flows are made to collide with the cleaning object, so as to clean the cleaning object.

Patent Document 1: Japanese Patent No. 2791862

Patent Document 2: Japanese Laid-Open Patent Application No. 2002-28581

Patent Document 3: Japanese Patent No. 3288462

Patent Document 4: Japanese Laid-Open Patent Application No. 2003-190247

In the dry type cleaning apparatus disclosed in Patent Document 3, cleaning objects are continuously cleaned by continuously moving the cleaning objects and the contact members from an upstream side to a downstream side in the rotating cylinder. Accordingly, the cleaning objects may contact and damage each other. Therefore, it is difficult to apply this technology to fragile resin products.

With the dry type cleaning apparatus disclosed in Patent Document 4, at least one cleaning object is loaded into the cleaning tank and removed after a certain amount of time. Therefore, cleaning objects cannot be continuously cleaned by this method.

SUMMARY OF THE INVENTION

The present invention provides a dry type cleaning apparatus and a dry type cleaning method in which one or more of the above-described disadvantages is eliminated.

A preferred embodiment of the present invention provides a dry type cleaning apparatus and a dry type cleaning method with which cleaning objects of various types of materials can be efficiently cleaned, and cleaning objects can be continuously loaded into the apparatus to be continuously cleaned.

An embodiment of the present invention provides a dry type cleaning apparatus for removing dust adhering to a cleaning object with a cleaning medium caused to flow by a high-speed airflow, the dry type cleaning apparatus including a cleaning tank; a separating unit; an air supply/discharge unit; and a moving unit; wherein the cleaning tank includes a cleaning object inlet from which the cleaning object is inserted, a lid configured to seal the cleaning object inlet, a bottom part that is open, and a cleaning object fixing unit provided between the cleaning object inlet and the bottom part, including plural openings through which the cleaning medium can pass, the separating unit includes a porous member provided at the bottom part of the cleaning tank, the porous member including holes through which air, dust, and granular material can pass but the cleaning medium cannot pass, the air supply/discharge unit includes a blowing unit configured to blow air into the cleaning tank through the porous member of the separating unit, and a suction unit configured to suction air from the cleaning tank through the porous member of the separating unit and discharge the suctioned air outside, and the moving unit is configured to move the separating unit and the air supply/discharge unit relatively to each other.

An embodiment of the present invention provides a dry type cleaning apparatus for removing dust adhering to a cleaning object with a cleaning medium caused to flow by a high-speed airflow, the dry type cleaning apparatus including plural cleaning tanks; a cleaning tank guiding unit; an air supply/discharge unit; and a cleaning tank moving unit; wherein each of the cleaning tanks includes a cleaning object inlet from which the cleaning object is inserted, a lid configured to seal the cleaning object inlet, a bottom part covered by a porous member including holes through which air, dust, and granular material can pass but the cleaning medium cannot pass, and a cleaning object fixing unit provided between the cleaning object inlet and the bottom part, including plural openings through which the cleaning medium can pass the cleaning tank guiding unit includes a guiding surface configured to guide movement of the cleaning tanks mounted thereon, the guiding surface being provided at a top of the cleaning tank guiding unit, and plural combinations arranged along a direction of movement of the cleaning tanks, each of the combinations including a suction opening and a blowing opening connected to the air supply/discharge unit, the air supply/discharge unit includes blowing units configured to blow air into the cleaning tank through the porous member of the cleaning tank, the blowing units being connected to the blowing openings of the cleaning tank guiding unit, and suction units configured to suction air from the cleaning tank through the porous member of the cleaning tank and discharge the suctioned air outside, the suction units being connected to the suction openings of the cleaning tank guiding unit, and the cleaning tank moving unit is configured to move the cleaning tanks along the guiding surface of the cleaning tank guiding unit.

An embodiment of the present invention provides a dry type cleaning method of removing dust adhering to a cleaning object with a cleaning medium caused to flow by a high-speed airflow, and separating the removed dust from the cleaning medium with a porous member including holes through which air, dust, and granular material can pass but the cleaning medium cannot pass, the dry type cleaning method including a step of switching an area on the porous member where air is received to cause the cleaning medium to flow and an area on the porous member where suction air is received to suction the dust separated from the cleaning medium.

According to one embodiment of the present invention, a dry type cleaning apparatus and a dry type cleaning method are provided, with which cleaning objects of various types of materials can be efficiently cleaned, and cleaning objects can be continuously loaded into the apparatus to be continuously cleaned.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

Figure 1:
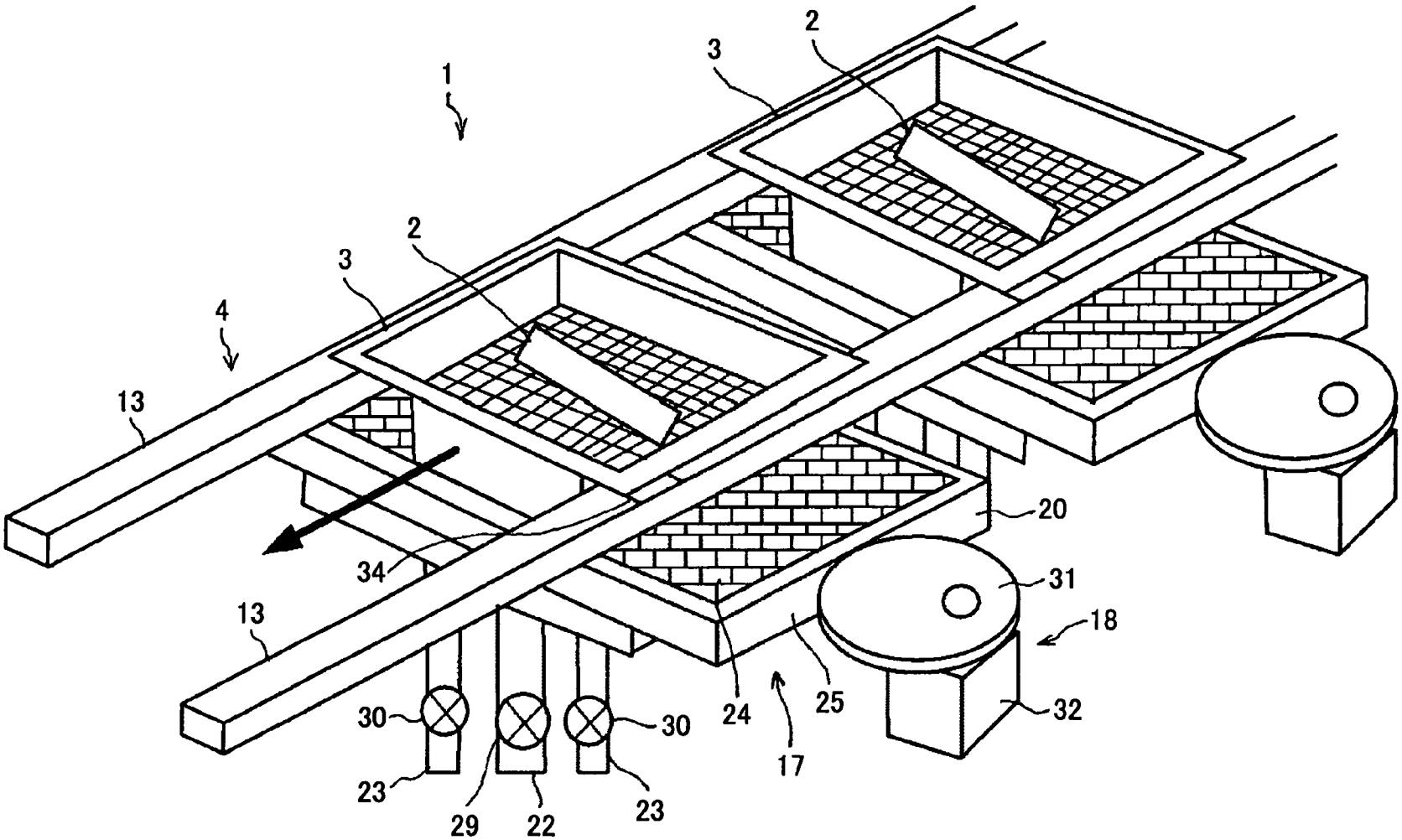
FIG. 1 is a schematic diagram of a dry type cleaning apparatus according to a first embodiment of the present invention.

FIG. 1 is a schematic diagram of a dry type cleaning apparatus 1 according to a first embodiment of the present invention. The dry type cleaning apparatus 1 removes dust such as toner adhering to a cleaning object 2, with a cleaning medium flowing on a high-speed airflow. The dry type cleaning apparatus 1 includes a cleaning tank 3, a cleaning tank moving unit 4, and a cleaning medium flying unit 5 (see FIG. 2).

Figure 2:
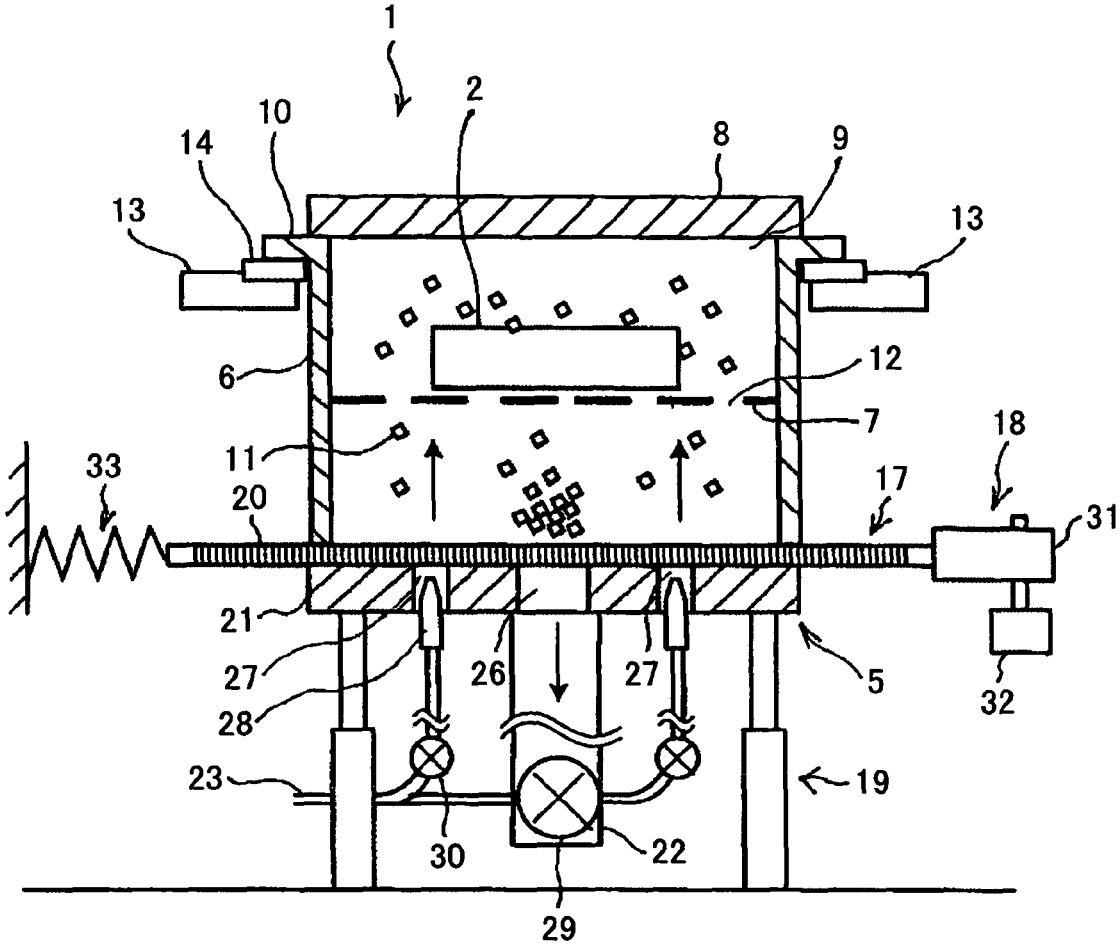
FIG. 2 is a cut-away side view of the dry type cleaning apparatus shown in FIG. 1.

FIG. 2 is a cut-away side view of the dry type cleaning apparatus 1. The cleaning tank 3 includes a cleaning tank body 6, a cleaning object fixing unit 7, and a lid 8. A cleaning object inlet 9 is provided at the top of the cleaning tank body 6, from which the cleaning object 2 is inserted. The entire bottom of the cleaning tank body 6 is open. A guide part 10 that engages the cleaning tank moving unit 4 is provided at the periphery of the top edge of the cleaning tank 3. The cleaning object fixing unit 7 has plural openings 12 large enough to allow a cleaning medium 11 to pass through. The cleaning object fixing unit 7 can be, for example, a wire mesh, a plastic mesh, or a net. The cleaning object fixing unit 7 is provided in the middle of the cleaning object inlet 9 and the bottom of the cleaning tank body 6.

Figure 3:
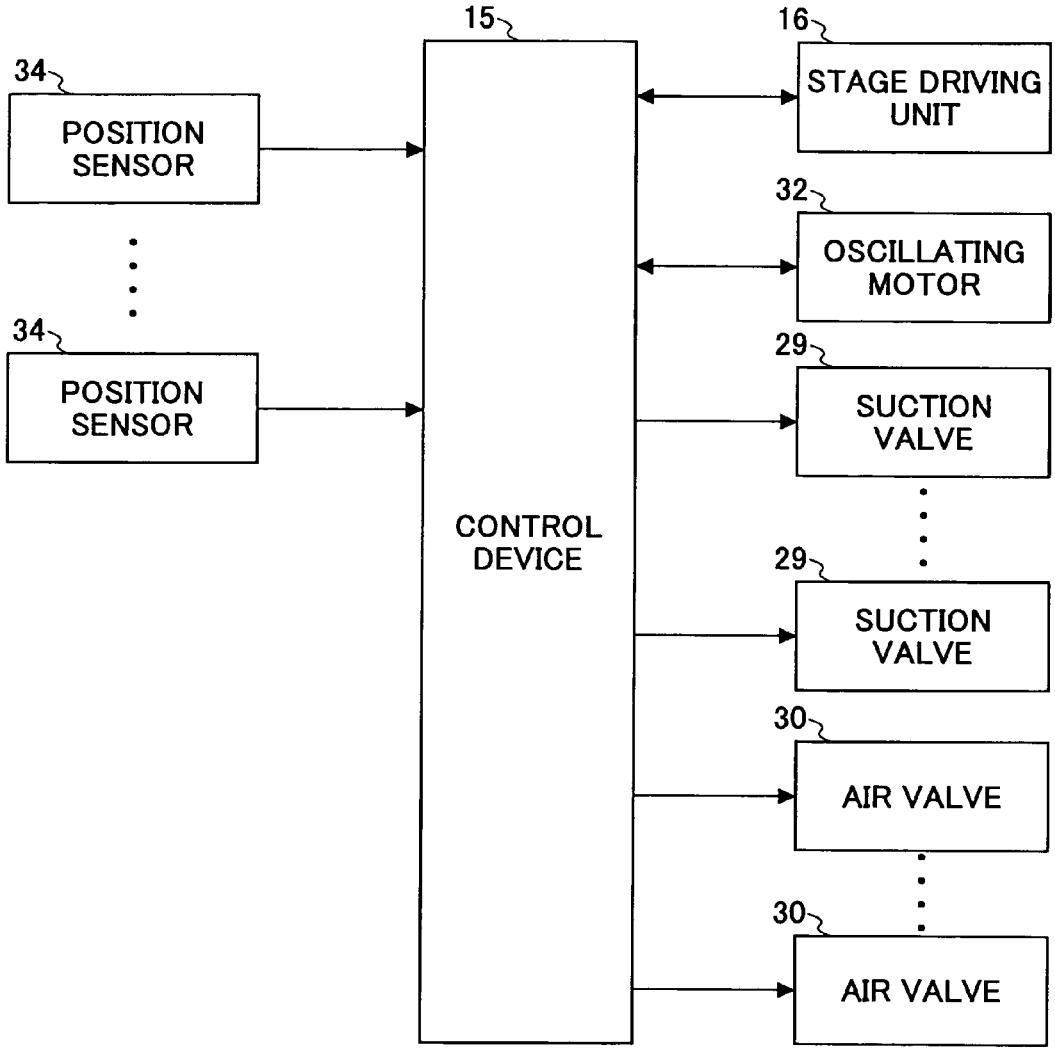
FIG. 3 is a block diagram of a control device and various input/output units according to the first embodiment.

The cleaning tank moving unit 4 includes a pair of slide rails 13 and at least one slide stage 14. The slide stage 14 holds the cleaning tank 3. FIG. 3 is a block diagram of a control device 15 and various input/output units. The slide stage 14 is driven/controlled by the control device 15. For example, a stage driving unit 16 including a wire driving mechanism and a linear motor causes the slide stage 14 to intermittently move along the slide rails 13.

The cleaning medium flying unit 5 includes a separating unit 17, an oscillating unit 18, and an elevator unit 19. The separating unit 17 separates the cleaning medium 11 and dust. Beneath the pair of slide rails 13, the cleaning medium flying unit 5 is provided singularly, or plural cleaning medium flying units 5 are provided with predetermined intervals. The separating unit 17 includes a separating member 20, a fixing plate 21, a suction pipe 22, and air pipes 23. The separating member 20 has many small holes and slits through which gas and dust can pass but the cleaning medium 11 cannot pass. The separating member 20 includes a porous member 24 (see FIG. 1), e.g., a mesh such as a wire mesh and a plastic mesh, a net, non-woven fabric, a sponge film, a punch-metal plate, a honeycomb plate, a porous plate, and a slit plate, and a holding frame 25 (see FIG. 1) for holding the porous member 24. The separating member 20 is provided on the top surface of the fixing plate 21 in an orthogonal direction with respect to the pair of slide rails 13, in an oscillatable manner. The separating member 20 is larger than the bottom opening of the cleaning tank 3, so that even when the separating member 20 oscillates, the bottom opening of the cleaning tank 3 is covered. The fixing plate 21 includes a suction opening 26 connected to the suction pipe 22, and air openings 27 connected to the air pipes 23. The air openings 27 are provided on both sides of the suction opening 26 in a direction of oscillation of the separating member 20. One end of the suction pipe 22 is connected to the suction opening 26 of the fixing plate 21, while the other end is connected to a suction device such as a blower. Each of the air pipes 23 is covered with a nozzle 28 at one end, and the nozzles 28 are connected to the air openings 27 of the fixing plate 21. The other ends of the air pipes 23 are connected with a compressed air supplying device. The suction pipe 22 and the air pipes 23 include a suction valve 29 and air valves 30, respectively, that open and close in response to control signals received from the control device 15. The oscillating unit 18 includes a cam 31 that engages the separating member 20 of the separating unit 17, an oscillating motor 32 that rotates the cam 31, and a position restricting unit 33 provided on the other side of the separating member 20, opposite to the side where the separating member 20 and the cam 31 are engaged. The position restricting unit 33 includes a compression spring and a buffer for thrusting the cam 31 against the separating member 20. The elevator unit 19 includes, for example, an air cylinder, an ascending edge detecting sensor, and a descending edge detecting sensor, and operates to raise or lower the separating unit 17 and the oscillating unit 18. A position sensor 34 is provided at the position of the cleaning medium flying unit 5 for detecting the cleaning tank 3 held by the slide stage 14 and sending signals to the control device 15 based on the detection.

The cleaning medium 11 used in the dry type cleaning apparatus 1 is a solid having shapes of granules, rods, cylinders, fiber, or thin flakes which are made of metal, ceramics, synthetic resin, sponge, cloth, etc. The cleaning medium 11 can be selected according to properties such as the shape and the material of the cleaning object 2 and/or properties of dust adhering to the cleaning object 2 such as the granular diameter and the adhering strength. In an image forming apparatus employing an electrophotographic method, the cleaning medium 11 is preferably flake-shaped, such as resin film flakes, cloth flakes, paper flakes or thin metal flakes for removing toner granules having average granular diameters of 5 μm through 10 μm, adhering to components made of synthetic resin or metal.

The flake-shaped cleaning medium 11 is preferable because it is extremely small in mass with respect to air resistance. Therefore, when force of an airflow is applied toward a direction of a large projection area, the cleaning medium 11 is easily accelerated by the airflow and is caused to fly at high speed. In a direction of a small projection area the air resistance is small, so that when the cleaning medium 11 is blown in this direction, the cleaning medium 11 continues to move at high speed for a long distance. The cleaning medium 11 has a high level of energy, so that the cleaning medium 11 applies a large force onto the cleaning object 2 when it contacts the cleaning object 2, thereby effectively removing dust adhering to the cleaning object 2. Further, as the cleaning medium 11 repeatedly circulates in the cleaning tank 3, the cleaning medium 11 is caused to contact the cleaning object 2 frequently, thereby improving cleaning efficiency.

Air resistance of the flake-shaped cleaning medium 11 changes significantly depending on the posture of the cleaning medium 11. Thus, the cleaning medium 11 not only moves along the airflow but also moves in a complicated manner, such as suddenly changing direction. Further, according to the effect of the high-speed airflow, turbulent flows are generated by the openings 12 of the cleaning object fixing unit 7 and the cleaning object 2. The flake-shaped cleaning medium 11 is affected by air resistance in proportion to its mass, and is highly likely to follow movements of the turbulent flows. Therefore, the cleaning medium 11 is caused to move in a complicated manner, and revolves due to swirls of the turbulent flows. Accordingly, the flake-shaped cleaning medium 11 repeatedly contacts the cleaning object 2 so that cleaning efficiency is enhanced even if the cleaning object 2 has a relatively complex shape.

Figure 4A:
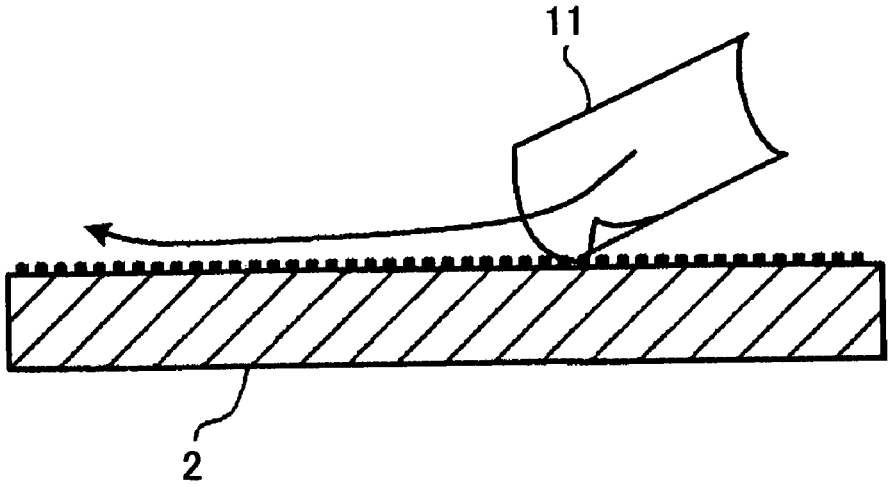
FIGS. 4A, 4B are schematic diagrams of a cleaning medium removing granular materials adhering to a cleaning object.
Figure 4B:
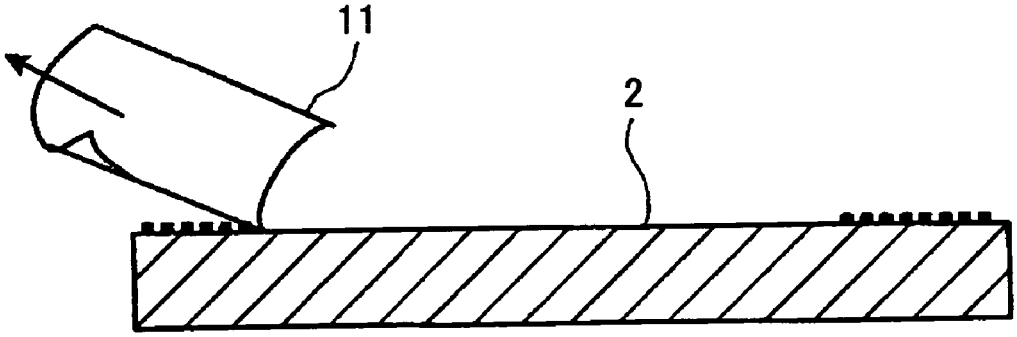

As shown in FIGS. 4A, 4B, when the flake-shaped cleaning medium 11 collides with the cleaning object 2 from the edge of the flake-shaped cleaning medium 11, the contact force concentrates at the edge of the flake-shaped cleaning medium 11. Accordingly, even though the flake-shaped cleaning medium 11 has a small mass, a sufficient amount of force can be achieved for removing dust, etc. As the contact force on the cleaning object 2 increases, the flake-shaped cleaning medium 11 bends, and therefore the force decreases. Accordingly, unlike the case of general-use materials such as a blast-shot material or an abrasive material used for barrel processing, the flake-shaped cleaning medium 11 does not apply excessive force on the cleaning object 2, so that the cleaning object 2 is not damaged. Further, the flake-shaped cleaning medium 11 bends as it collides with the cleaning object 2 and a high level of viscosity resistance is received from air, so that the collision becomes inelastic, and the flake-shaped cleaning medium 11 does not bounce back. When the flake-shaped cleaning medium 11 collides with the cleaning object 2 at an oblique angle, it comes in sliding contact with the cleaning object 2. Specifically, after colliding, the flake-shaped cleaning medium 11 slides along while scraping and rubbing a wide area of the cleaning object 2. Accordingly, the toner particles adhering to the surface of the cleaning object 2 receive a force parallel to the surface from the flake-shaped cleaning medium 11. Thus, the toner particles can be separated from the cleaning object 2 by using only a small force, thereby enhancing cleaning efficiency.

Deformation and/or oscillation occurs as the flake-shaped cleaning medium 11 collides with the separating member 20, causing dust particles, etc., adhering to the cleaning object 2 to be easily separated from the cleaning object 2, and prevents them from adhering to the cleaning object 2 once again.

As the flake-shaped cleaning medium 11 can efficiently remove dust such as toner particles adhering to the cleaning object 2, only a small amount of flake-shaped cleaning medium 11 is required, thereby reducing the environmental impact and running cost.

A description is given of an operation of causing the flake-shaped cleaning medium 11 to fly and circulate inside the cleaning tank 3 to remove dust such as toner particles adhering to the cleaning object 2.

The flake-shaped cleaning medium 11 is piled onto the separating unit 17 of the cleaning medium flying unit 5 in advance, and the separating unit 17 and the oscillating unit 18 are lowered to a predetermined lower end by the elevator unit 19. In this condition, on the cleaning tank insertion side of the slide rails 13, the cleaning object 2 is fixed to the cleaning object fixing unit 7 in the cleaning tank 3. Then, the cleaning object inlet 9 of the cleaning tank 3 is sealed with the lid 8. The cleaning tanks 3 containing the cleaning objects 2 are sequentially placed on the slide stages 14 and sequentially moved by the stage driving units 16. When the slide stage 14 holding the cleaning tank 3 reaches the position of the cleaning medium flying unit 5 and the position sensor 34 detects the cleaning tank 3 held by the slide stage 14, the control device 15 stops the stage driving unit 16 from moving the slide stage 14. Then, at a predetermined timing, the elevator unit 19 lifts the separating unit 17 and the oscillating unit 18. As the separating unit 17 and the oscillating unit 18 reach an upper end, and the separating member 20 of the separating unit 17 contacts the cleaning tank body 6 by a predetermined force, the control device 15 operates as follows. That is, the control device 15 opens the suction valve 29 and the air valves 30, suctions (removes) air from inside the cleaning tank 3 with the suction pipe 22, and blows compressed air from the nozzles 28 of the air pipes 23 into the cleaning tank 3 to generate a high-speed airflow within the cleaning tank 3, thereby causing the cleaning medium 11 piled on the separating member 20 to fly and stirring the cleaning medium 11. At the same time, the control device 15 drives the oscillating motor 32 of the oscillating unit 18 to oscillate the separating unit 17. The high-speed airflow, at a flow velocity of preferably at least greater than or equal to 10 m/s, more preferably greater than or equal to 50 m/s, causes the cleaning medium 11 to fly at a speed of 5 m/s, more preferably at 10 m/s.

Figure 5A:
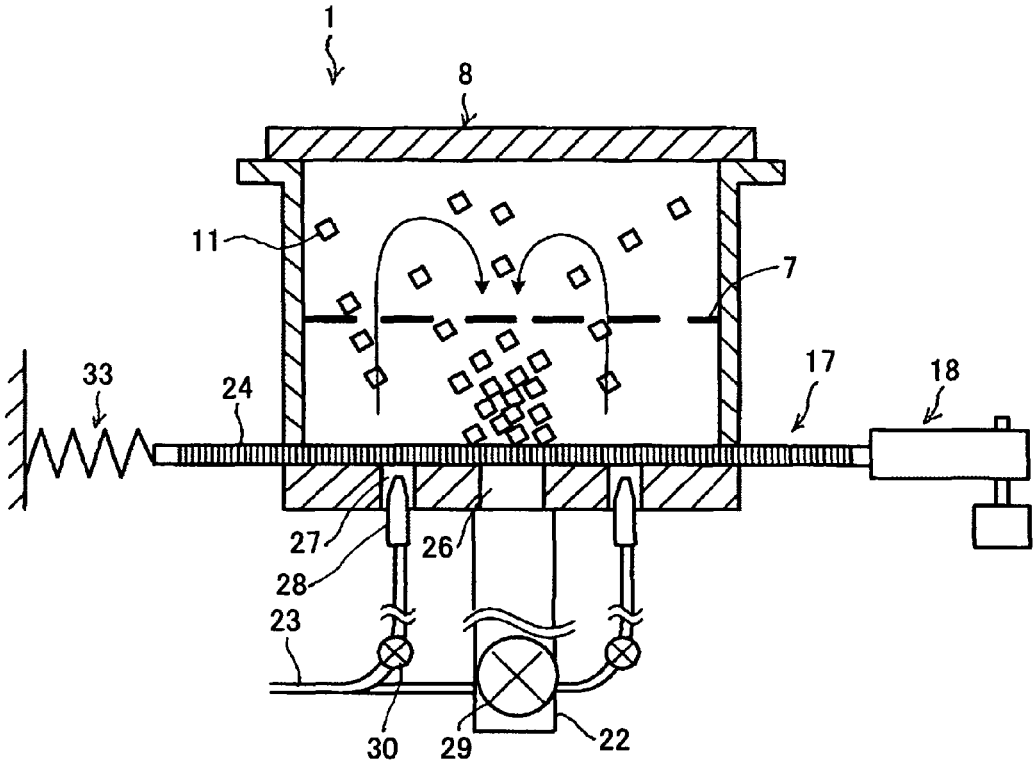
FIGS. 5A, 5B are cut-away side views of the dry type cleaning apparatus shown in FIG. 1 in which cleaning medium is flying.
Figure 5B:
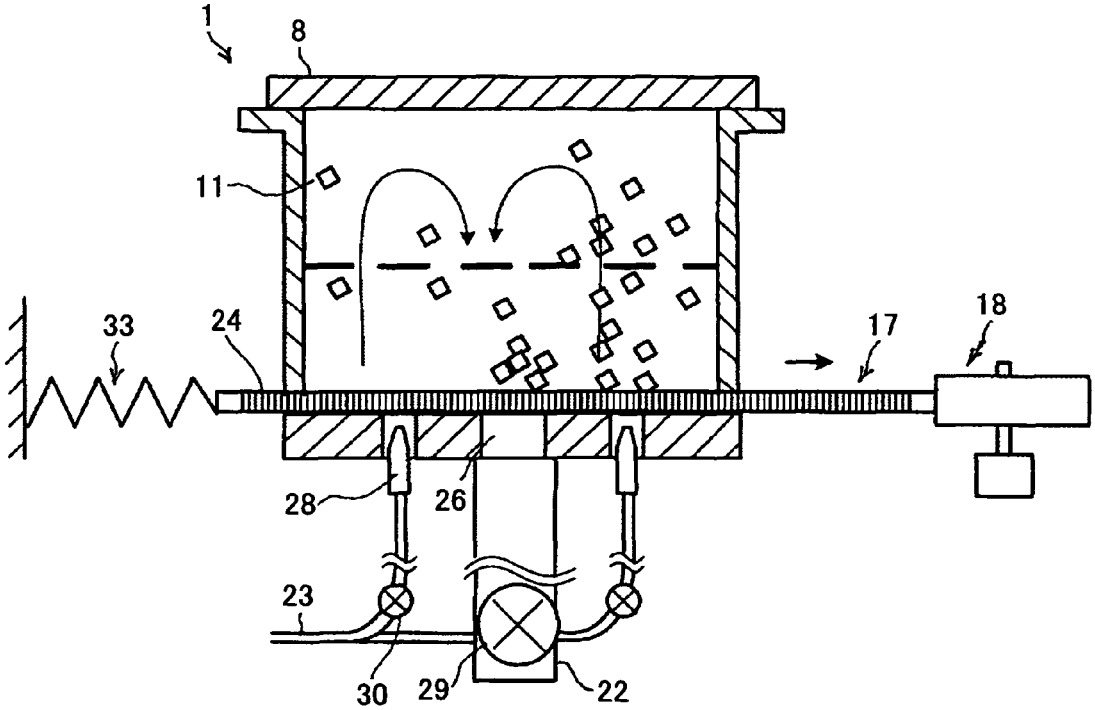

FIG. 5A illustrates how the cleaning medium 11 behaves. The cleaning medium 11 flies through the openings 12 of the cleaning object fixing unit 7, collides with the cleaning object 2, and separates granular material such as toner particles from the cleaning object 2. As an airflow is generated by suction from the suction pipe 22, the cleaning medium 11 and the separated particles are caused to collide with the separating member 20. The separated particles pass through the separating member 20 and are suctioned by the suction pipe 22. Particles adhering to the cleaning medium 11 are separated from the cleaning medium 11, suctioned through the separating member 20, and removed. The cleaning medium 11 separated from the particles is cleaned by the airflow, and accumulated on the separating member 20 around a position opposite to the suction opening 26 connected to the suction pipe 22. If the cleaning medium 11 is accumulated in this manner, the separating member 20 will be clogged and the suction force will be decreased, thereby decreasing the speed of the airflow that causes the cleaning medium 11 to fly. To prevent such a situation, the oscillating unit 18 moves the separating member 20 in a horizontal direction as shown in FIG. 5B. Specifically, the position where the cleaning medium 11 is accumulated on the separating member 20 is moved to positions opposite to the air openings 27 connected to the nozzles 28 of the air pipes 23, so that compressed air blown out from the nozzles 28 causes the accumulated cleaning medium 11 to fly. The oscillating unit 18 horizontally moves the separating member 20 back and forth between the two positions opposite to the air openings 27 situated on both sides of the position opposite to the suction opening 26. This ensures that the cleaning medium 11 accumulated on the separating member 20 is caused to fly, so that the separating member 20 is prevented from being clogged. Accordingly, airflows within the cleaning tank 3 are maintained at high speed, thereby steadily removing toner particles adhering to the cleaning object 2 with the flying cleaning medium 11.

This process is continued for a certain amount of time until the cleaning object 2 is thoroughly cleaned. The control device 15 then closes the air valves 30 to stop the compressed air from being blown out of the nozzles 28 of the air pipes 23, and the oscillating unit 18 stops oscillating the separating member 20. By stopping the compressed air from being blown in the cleaning tank 3 and stopping the separating member 20 from being oscillated, the cleaning medium 11 flying in the cleaning tank 3 and the cleaning medium 11 adhering to the cleaning object 2, etc., is suctioned to and accumulated at the position on the separating member 20 opposite to the suction opening 26 of the separating unit 17. After the suction pipe 22 performs suction for a certain amount of time, the control device 15 closes the suction valve 29 and lowers the separating unit 17 and the oscillating unit 18 with the elevator unit 19. When the separating unit 17 and the oscillating unit 18 reach the lower end, the control device 15 drives the stage driving unit 16 to move forward the slide stage 14 holding the cleaning tank 3. When the slide stage 14 holding the cleaning tank 3 containing the cleaning object 2 to be cleaned next fixed therein reaches the position above the cleaning medium flying unit 5, the slide stage 14 is stopped and the above-described process is repeated.

Accordingly, plural cleaning objects 2 can be continuously cleaned, thereby enhancing cleaning efficiency. Further, only when the slide stage 14 holding the cleaning tank 3 is at the position above the cleaning medium flying unit 5, compressed air is blown in the cleaning tank 3 and air inside the cleaning tank 3 is suctioned. Therefore, unnecessary compressed air and unnecessary suction can be eliminated, which leads to energy saving.

In the above description, the separating member 20 of the separating unit 17 is moved back and forth in order to prevent the separating member 20 from being clogged by the cleaning medium 11. However, it is possible to fix the separating member 20 while moving back and forth the fixing plate 21 connected to the suction pipe 22 and the air pipes 23. In this manner, an area on the separating member 20 where air in the cleaning tank 3 is suctioned and an area on the separating member 20 where compressed air is blown into the cleaning tank 3 are switched.

In the above descriptions, in order to prevent the separating member 20 from being clogged by the cleaning medium 11, either the separating member 20 or the fixing plate 21 connected to the suction pipe 22 and the air pipes 23 is moved back and forth, so that an area on the separating member 20 where air in the cleaning tank 3 is suctioned and an area on the separating member 20 where compressed air is blown into the cleaning tank 3 are switched. However, it is also possible to intermittently move the cleaning tank 3, so that an area on the separating member 20 where air in the cleaning tank 3 is suctioned and an area on the separating member 20 where compressed air is blown into the cleaning tank 3 are switched.

Figure 6:
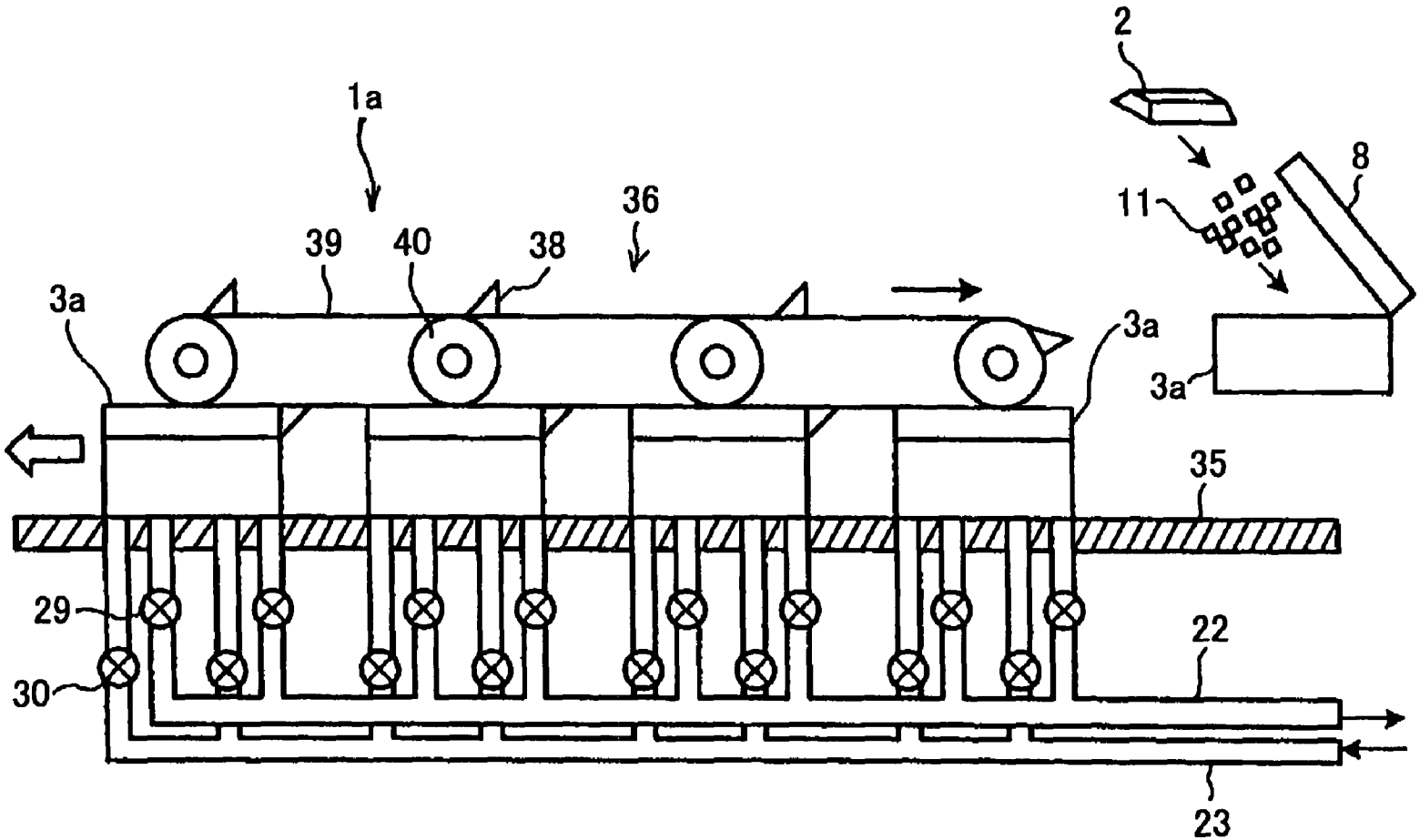
FIG. 6 is a schematic diagram of a dry type cleaning apparatus according to a second embodiment of the present invention.

In a dry type cleaning apparatus 1*a* according to a second embodiment of the present invention, the cleaning tank 3 is moved intermittently so that an area on the separating member 20 where air in the cleaning tank 3 is suctioned and an area on the separating member 20 where compressed air is blown into the cleaning tank 3 are switched. As shown in FIG. 6, the dry type cleaning apparatus 1*a* includes a linear guide 35 on which plural cleaning tanks 3*a* are mounted, plural suction pipes 22 and plural air pipes 23 connected to the linear guide 35, and a cleaning tank moving unit 36 for pressing the cleaning tanks 3*a* against the linear guide 35 and moving the cleaning tanks 3*a*.

Figure 7:
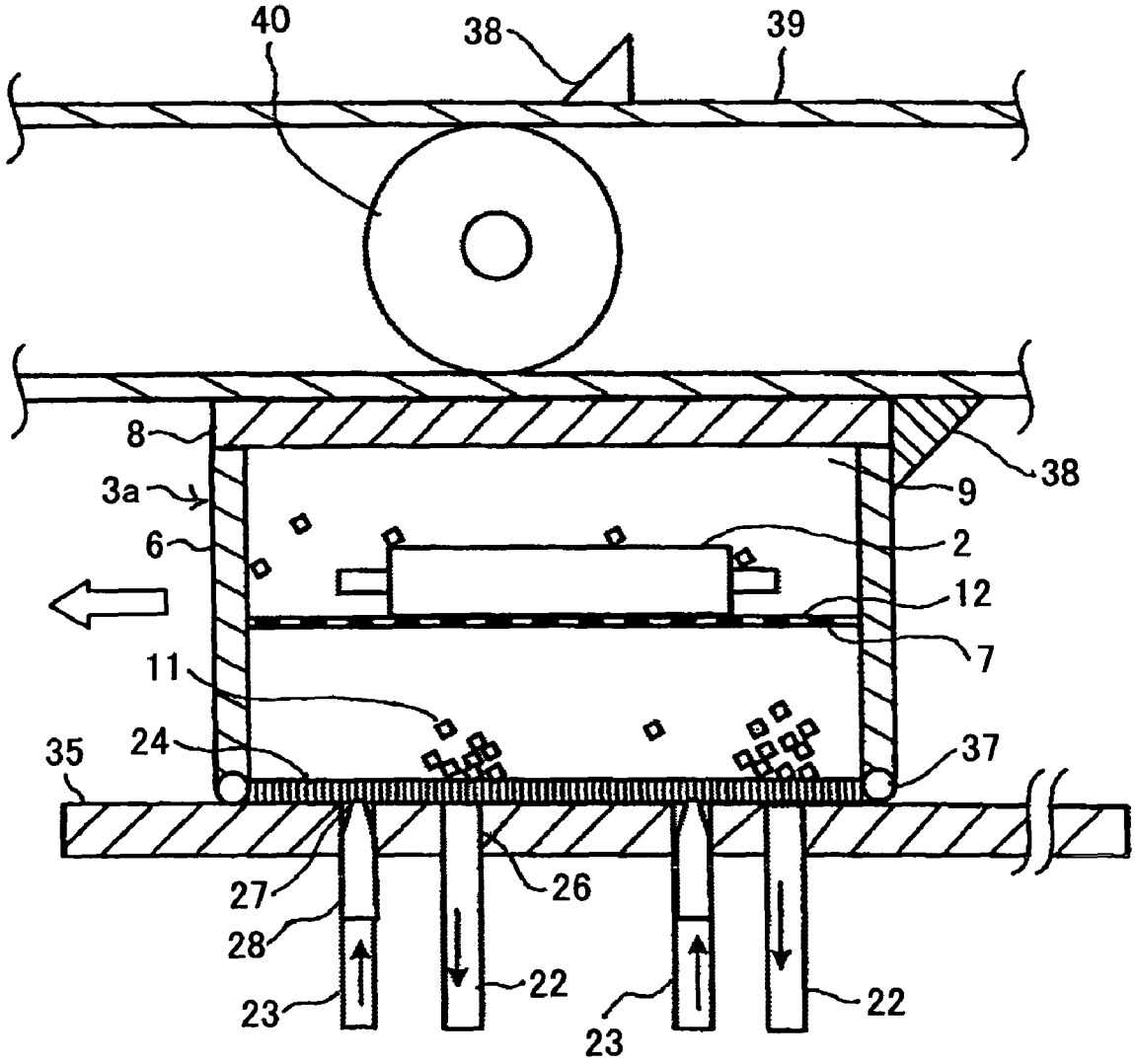
FIG. 7 is a partial cut-away side view of the dry type cleaning apparatus shown in FIG. 6.

As shown in FIG. 7, the cleaning tank body 6 of each cleaning tank 3*a* includes the cleaning object inlet 9 provided at the top thereof, from which the cleaning object 2 is inserted, and the lid 8 for sealing the cleaning object inlet 9. The bottom of the cleaning tank body 6 is covered with the porous member 24 including many small holes and slits through which gas and dust can pass but the cleaning medium 11 cannot pass. The bottom edges of the side walls are entirely sealed by seal members 37, which are made of rubber or synthetic resin such as nitrile rubber or fluorovinylidene rubber. In the middle of the cleaning object inlet 9 of the cleaning tank body 6 and the porous member 24, there is provided the cleaning object fixing unit 7 including plural openings 12 large enough to allow the cleaning medium 11 pass through. The top surface of the linear guide 35 is a planar guide surface, which guides the movement of the cleaning tanks 3*a*.

Figure 8A:
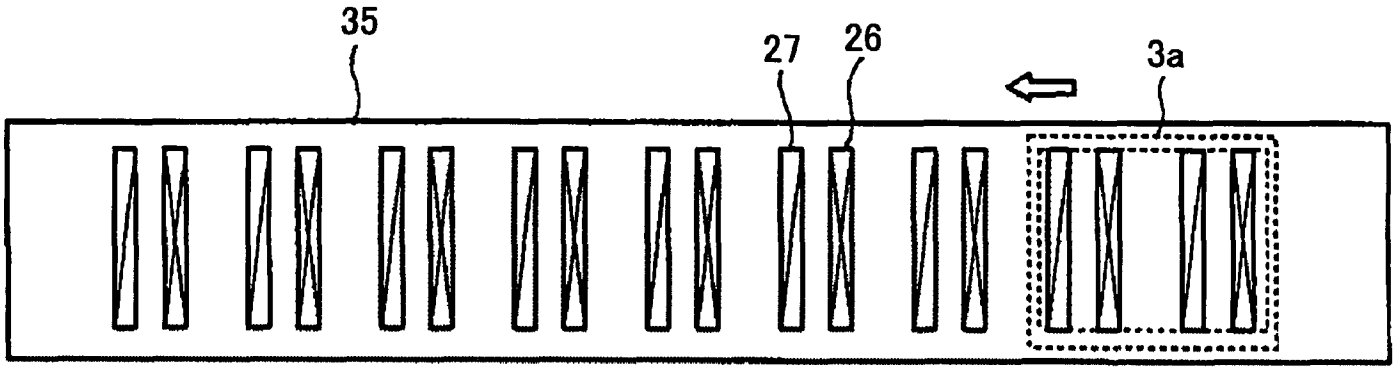
FIGS. 8A, 8B are schematic diagrams of arrangements of suction openings and air openings provided in a linear guide of the dry type cleaning apparatus shown in FIG. 6.
Figure 8B:
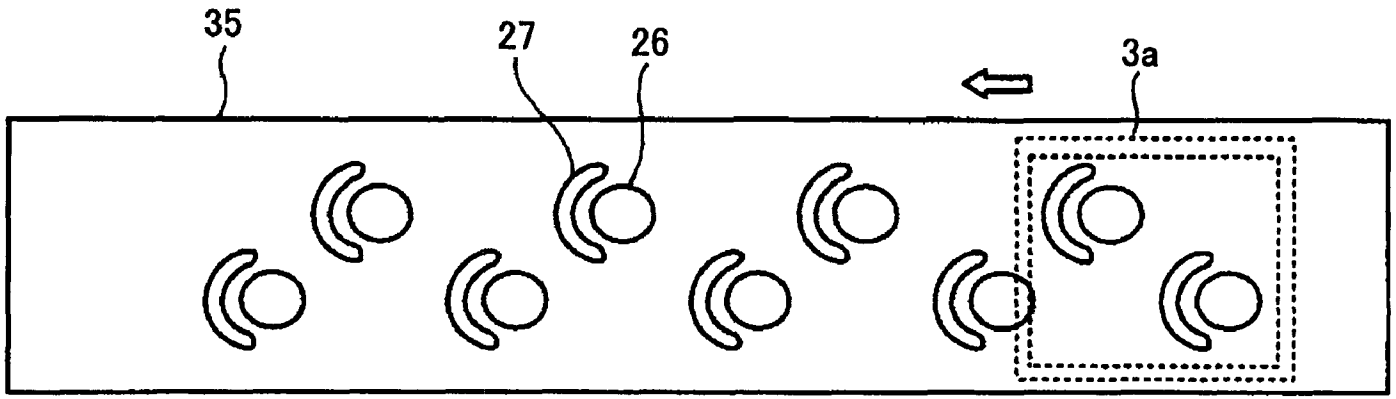
Figure 9:
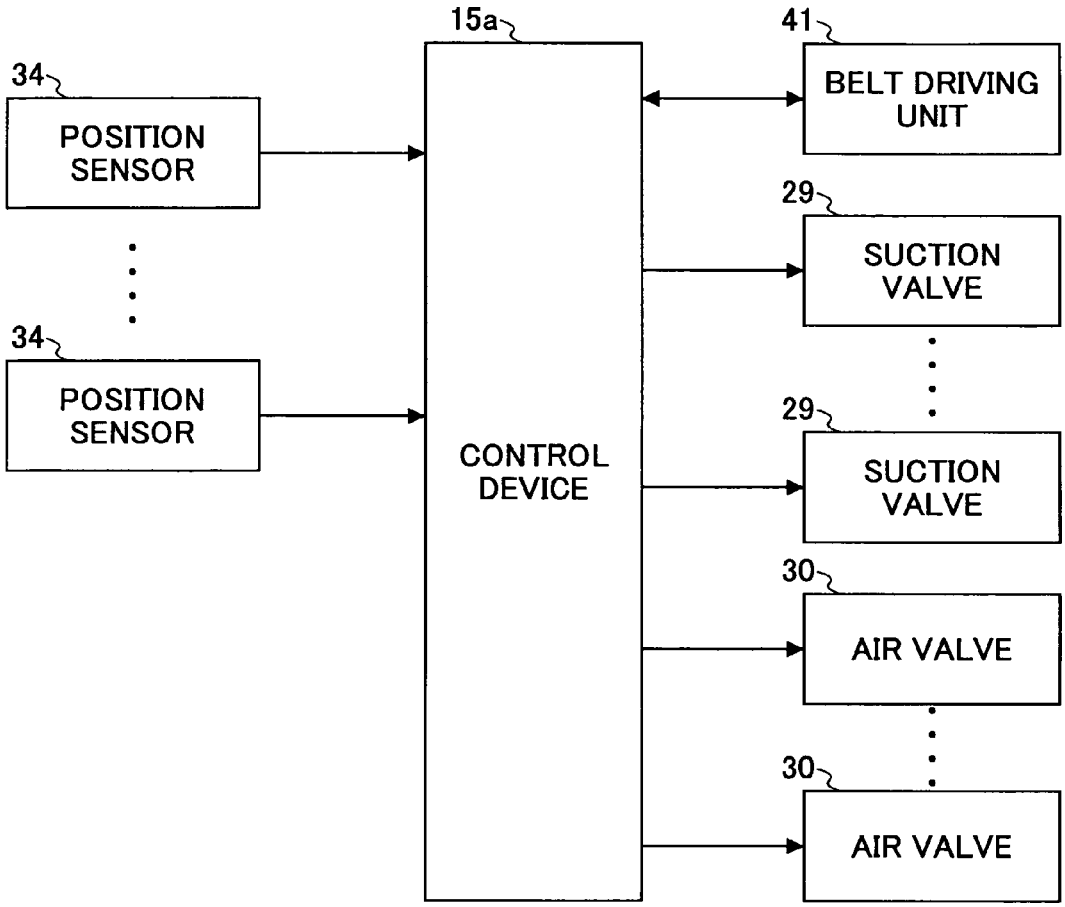
FIG. 9 is a block diagram of a control device and various input/output units according to the second embodiment.

As shown in FIGS. 8A, 8B, combinations of the suction opening 26 and the air opening 27 are provided in the linear guide 35. The suction openings 26 are connected with the suction pipes 22, and the air openings 27 are connected with the air pipes 23 and provided near the suction openings 26 in the direction of movement of the cleaning tanks 3*a*. Intervals between the combinations of the suction openings 26 and the air openings 27 are narrower than the width of each cleaning tank 3*a* in the direction of movement thereof. As shown in FIG. 8A, the suction openings 26 and the air openings 27 can be slits perpendicular to the direction of movement of the cleaning tanks 3*a*. As shown in FIG. 8B, the suction openings 26 can be circular and the air openings 27 can be arc-shaped, and arranged in a staggered manner along the direction of movement of the cleaning tanks 3*a*. The position sensors 34 are provided at each position where the combinations of the suction openings 26 and the air openings 27 are provided. Each of the suction pipes 22 is connected to one of the suction openings 26 of the linear guide 35 at one end, while the other end is connected to a suction device such as a blower. Each of the air pipes 23 is covered with the nozzle 28 at one end, and the nozzles 28 are connected to the air openings 27 of the linear guide 35. The other ends of the air pipes 23 are connected with a compressed air supplying device. As shown in FIG. 9, the suction pipes 22 and the air pipes 23 include the suction valves 29 and the air valves 30, respectively, that open and close in response to control signals received from the control device 15.

Referring back to FIG. 6, the cleaning tank moving unit 36 is a belt conveyer mechanism including a cleaning tank driving belt 39 provided with cleaning tank fixing pawls 38, and cleaning tank pressing rollers 40 for pressing the cleaning tanks 3*a* against the linear guide 35. As shown in FIG. 9, the cleaning tank moving unit 36 is driven by a belt driving unit 41 including a belt driving motor that operates according to belt driving control signals received from a control device 15*a*.

A description is given of an operation performed by the dry type cleaning apparatus 1*a* for causing the flake-shaped cleaning medium 11 to fly and circulate in the cleaning tank 3, and removing dust such as toner particles adhering to the cleaning object 2.

First, at an insertion section located at an upstream side of the cleaning tank moving unit 36 in the direction of movement of the cleaning tanks 3*a*, the lid 8 of the cleaning tank 3*a* is opened and the flake-shaped cleaning medium 11 is put in the cleaning tank 3*a*. The cleaning medium 11 passes through the openings 12 of the cleaning object fixing unit 7 and is held on the porous member 24. Next, the cleaning object 2 is placed inside the cleaning tank 3*a* and fixed to the cleaning object fixing unit 7. The lid 8 is closed so that the cleaning object inlet 9 of the cleaning tank 3*a* is sealed, and the cleaning tank 3*a* is mounted on the linear guide 35. In this manner, the cleaning tanks 3*a* are continuously loaded in the dry type cleaning apparatus 1*a*. Due to the friction of the cleaning tank driving belt 39 and the cleaning tank fixing pawls 38 of the cleaning tank moving unit 36, the cleaning tanks 3*a* loaded in the dry type cleaning apparatus 1*a* are equally spaced apart and conveyed in a fixed direction, being guided by the linear guide 35. When the position sensor 34 detects that the cleaning tank 3*a* being conveyed has reached a position of a combination of the suction opening 26 and the air opening 27, the control device 15*a* opens the suction valve 29 and the air valve 30, causes the suction pipe 22 to suction air from inside the cleaning tank 3*a*, and causes the nozzles 28 of the air pipe 23 to blow compressed air into the cleaning tank 3*a*. Accordingly, a high-speed airflow is generated within the cleaning tank 3*a*, which causes the cleaning medium 11 held on the porous member 24 to fly. The flying cleaning medium 11 flies through the openings 12 of the cleaning object fixing unit 7, collides with the cleaning object 2, and separates granular material such as toner particles from the cleaning object 2. As an airflow is generated by suction from the suction pipe 22, the cleaning medium 11 and the separated particles are caused to collide with the porous member 24. The separated particles pass through the porous member 24 and are suctioned by the suction pipe 22. Particles adhering to the cleaning medium 11 are separated from the cleaning medium 11, suctioned through the porous member 24, and removed. The cleaning medium 11 separated from the particles is cleaned by the airflow, and is accumulated on the porous member 24 around a position opposite to the suction opening 26. When the cleaning tank 3*a* is conveyed in the dry type cleaning apparatus 1*a*, the cleaning medium 11 accumulated on the porous member 24 also moves due to friction of the porous member 24. Further, the cleaning medium 11 is caused to fly again by the compressed air blown out of the air openings 27, and to collide with the cleaning object 2 and clean the cleaning object 2.

In the example shown FIG. 8A, the air openings 27 that cause the cleaning medium 11 to fly in the cleaning tank 3*a* and the suction openings 26 are provided as slits and arranged alternately. Thus the cleaning medium 11 is collected in the shape of a slit around the suction opening 26, and the collected cleaning medium 11 is caused to fly in the cleaning tank 3*a* by the compressed air blow out of the slit-shaped air opening 27. Accordingly, the cleaning medium 11 is caused to collide with the moving cleaning object 2 as if to scan the entire cleaning object 2, thereby cleaning a wide area of the cleaning object 2 and enhancing cleaning efficiency.

In the example shown FIG. 8B, the suction openings 26 are circular and the air openings 27 are arc-shaped, and are arranged in a staggered manner along the direction of movement of the cleaning tanks 3*a*. Thus the cleaning medium 11 can be caused to fly from an obliquely lower direction against the cleaning object 2 in the cleaning tank 3*a*, which facilitates the cleaning medium 11 colliding with the side surfaces of the cleaning object 2, and the cleaning medium 11 alternately collides with the cleaning object 2 from left and right sides. This enhances cleaning efficiency in cleaning all surfaces of the cleaning object 2 that is thick in three dimensions.

The suction openings 26 and the air openings 27 are arranged with intervals to ensure that there is always at least one combination located under the cleaning tank 3*a*. Therefore, wherever the cleaning tank 3*a* is located on the linear guide 35, there is an airflow generated in the cleaning tank 3*a* so that the cleaning medium 11 is continuously flying. Accordingly, cleaning efficiency is further enhanced.

The cleaning tanks 3*a* containing the cleaning objects 2 and the cleaning medium 11 are continuously moved by the cleaning tank moving unit 36, and therefore, it is possible to continuously clean the cleaning objects 2.

Figure 10:
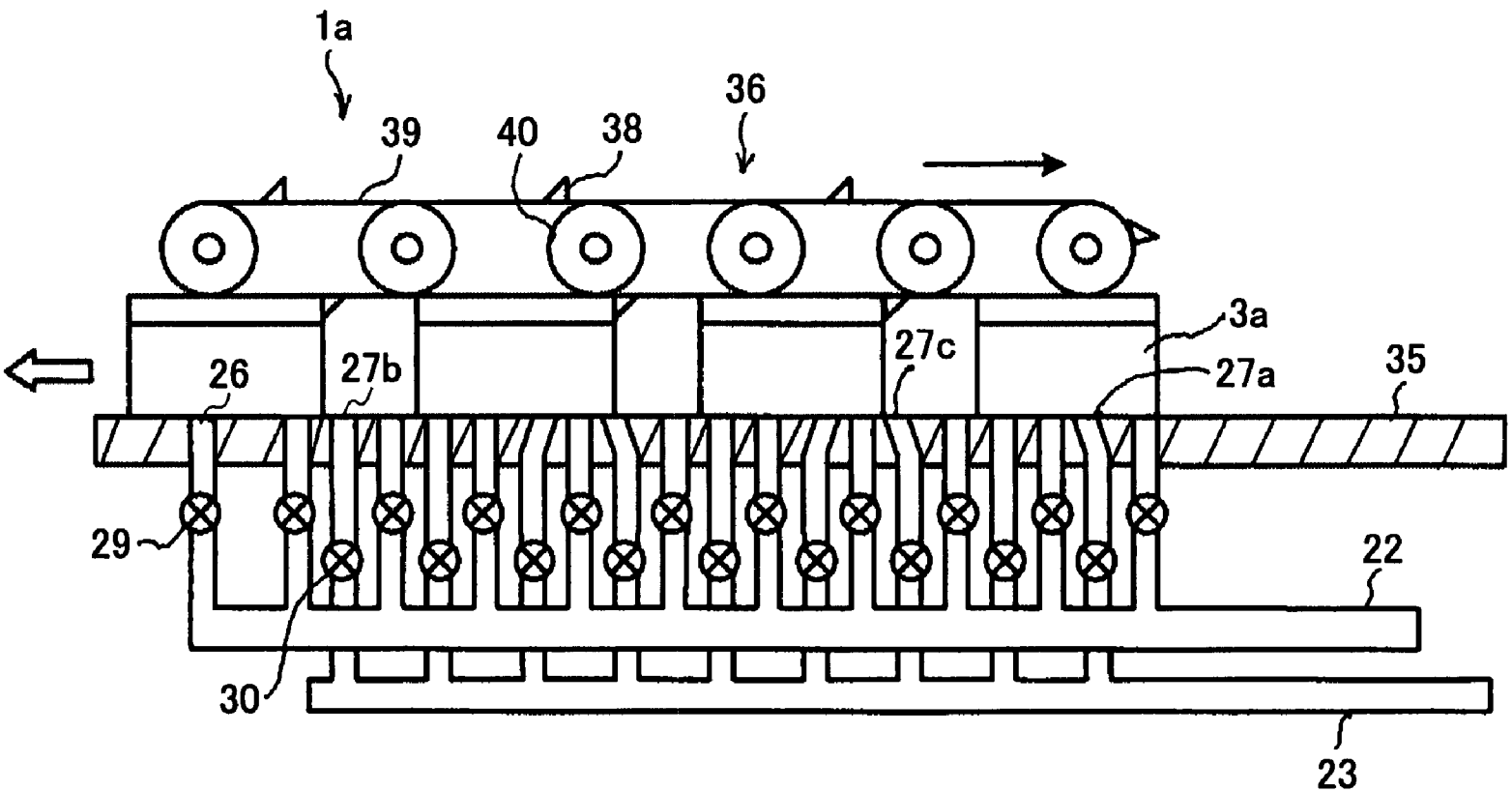
FIG. 10 is a variation of the dry type cleaning apparatus according to the second embodiment.

Further, some of the air openings 27 provided in the linear guide 35 can be tilted by a predetermined angle with respect to the linear guide 35, and the nozzles 28 covering ends of the air pipes 23 can be connected to the tilted air openings 27. For example, as shown in FIG. 10, there are air openings 27*a*, 27*b*, 27*c*, which are tilted at different angles with respect to the direction of movement of the cleaning tanks 3*a*, arranged appropriately in the linear guide 35. The air openings 27*a* are tilted at 45 degrees, the air openings 27*b* are perpendicular at 90 degrees, and the air openings 27*c* are tilted at 135 degrees. The nozzles 28 covering the tips of the air pipes 23 are connected to the air openings 27*a*, 27*b*, 27*c*, and blow out airflows in different directions into the cleaning tank 3*a* at different positions as the cleaning tank 3*a* is being moved by the linear guide 35. The cleaning medium 11 is accelerated by air flowing into the cleaning tank 3*a* being moved by the linear guide 35 at different positions at angles of 45 degrees, 90 degrees, and 135 degrees, and collides with the cleaning object 2 contained in the cleaning tank 3*a*. Accordingly, dirt can be removed from the cleaning object 2 facing the above-described angles. Therefore, even a three-dimensional cleaning object 2 can be uniformly cleaned.

In FIG. 10 the air openings 27*a*, 27*c* are tilted with respect to the direction of movement of the cleaning tanks 3*a*. However, the air openings 27 can be tilted in any direction. Further, the nozzles 28 can be configured to blow out airflows in different directions. These nozzles 28 can be connected to the air openings 27 so as to change the directions and the patterns of airflows blown into the cleaning tanks 3*a*. The cleaning medium 11 is accelerated by airflows of different directions and different patterns and therefore collides with the cleaning object 2 at various angles and by various patterns. Accordingly, the airflows compensate for each other for cleaning different areas of the cleaning object 2, so that the entire cleaning object 2 is thoroughly cleaned.

Further, as shown in FIG. 10, at the position immediately before a cleaning tank retrieving outlet provided at the downstream side of the cleaning tank moving unit 36 in the direction of movement of the cleaning tanks 3*a*, it is preferable to provide only the suction openings 26 connected with the suction pipes 22 in the linear guide 35. By providing only the suction openings 26 immediately before the cleaning tank retrieving outlet of the in the linear guide 35, just before the cleaning tank 3*a* is discharged from the linear guide 35, air in the cleaning tank 3*a* is suctioned so that the cleaning medium 11 is fixed on the porous member 24 and is prevented from flying and scattering. Accordingly, the airflow generated by suction causes the cleaning medium 11 adhering to the cleaning object 2 to separate from the cleaning object 2 and prevents it from adhering to the cleaning object 2 once again. Further, while the air inside the cleaning tank 3*a* is being suctioned, a user can open the lid 8 of the cleaning tank 3*a* and spray an airflow onto the cleaning object 2 with an air gun. The cleaning medium 11 blown off the cleaning object 2 by the airflow of the air gun is fixed onto the porous member 24 and is prevented from scattering. Accordingly, the cleaning medium 11 can be thoroughly separated from the cleaning object 2.

Figure 11:
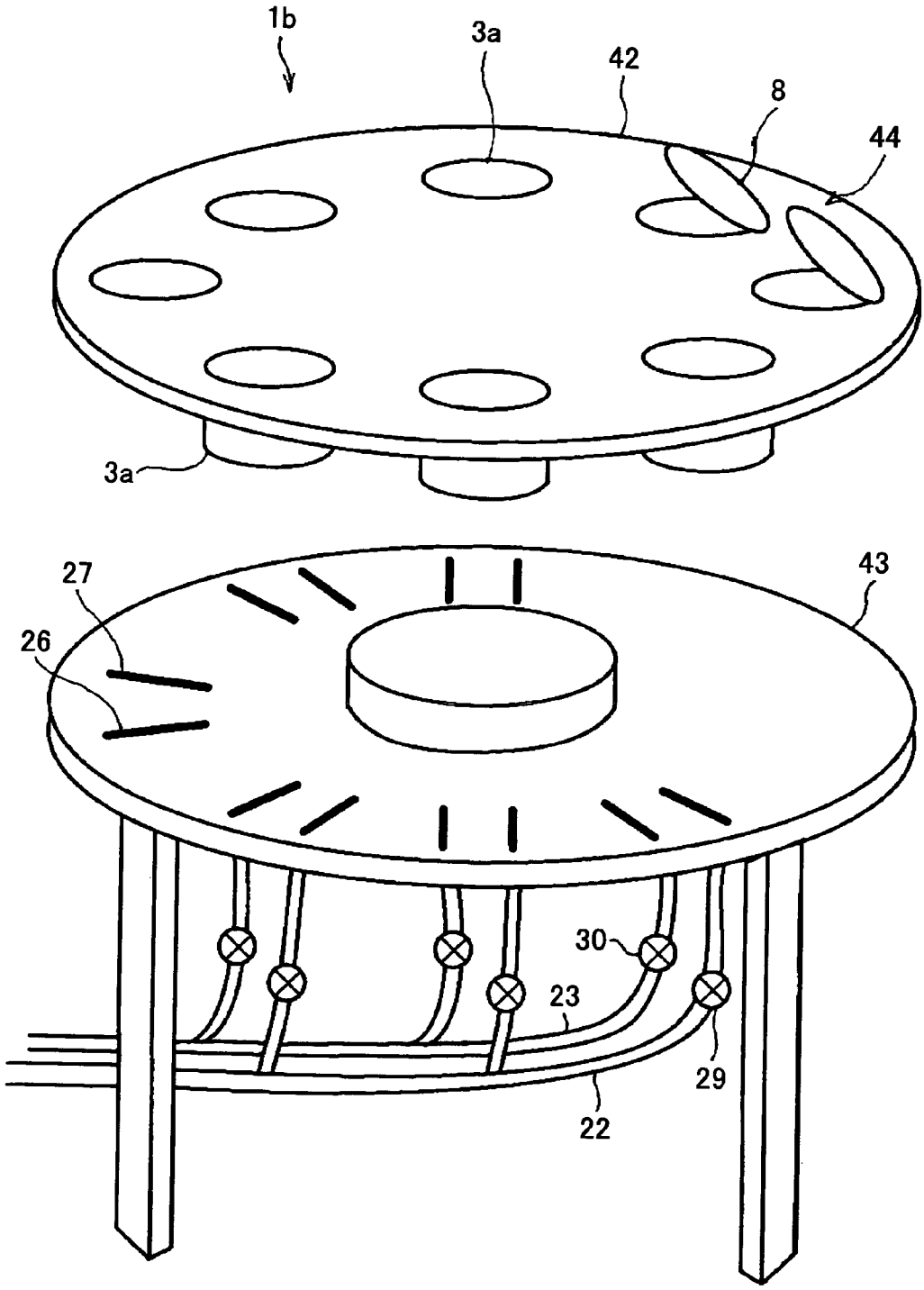
FIG. 11 is a disassembled perspective view of a dry type cleaning apparatus according to a third embodiment of the present invention.
Figure 12:
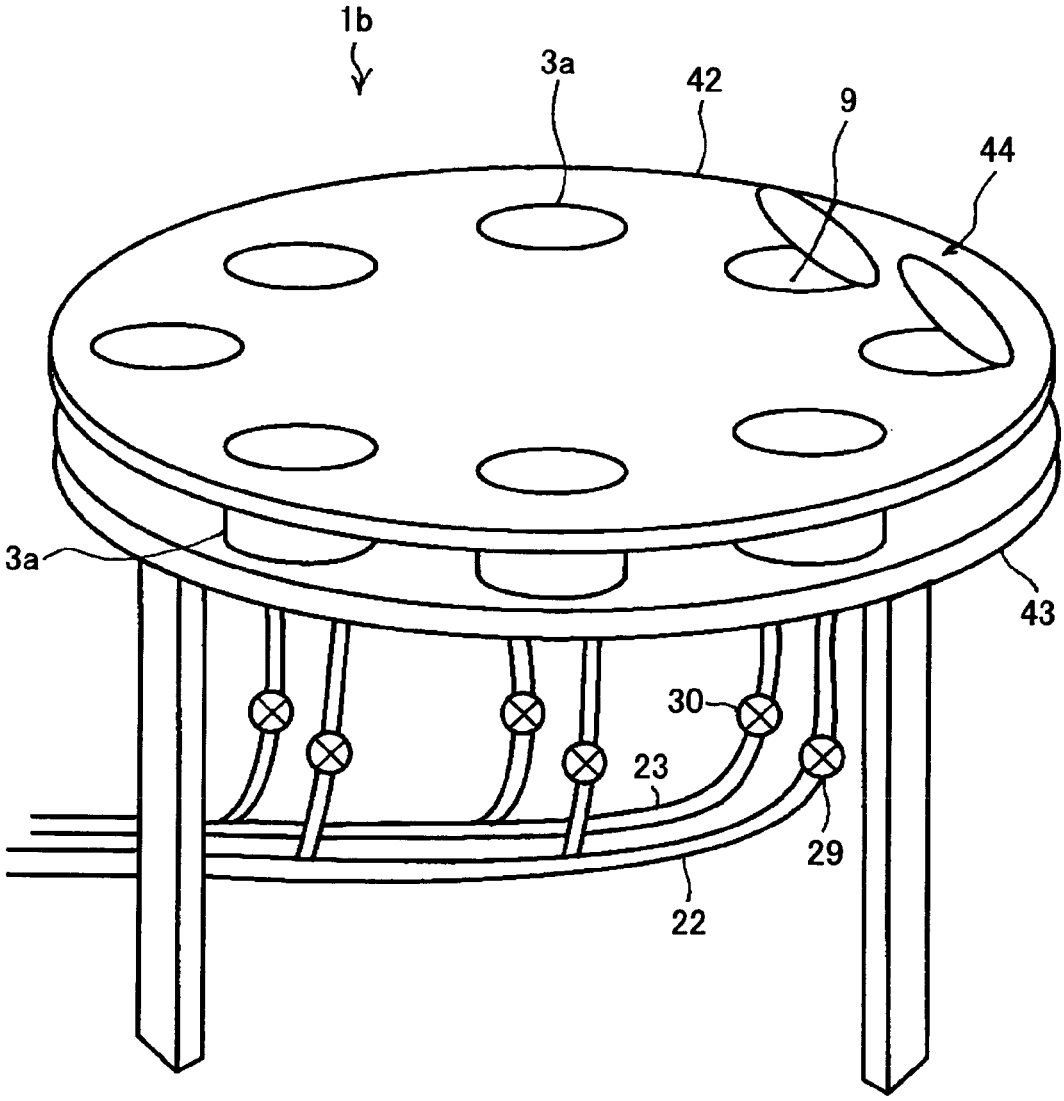
FIG. 12 is a perspective. view of the dry type cleaning apparatus according to the third embodiment.

In the second embodiment, the cleaning objects 2 are cleaned in the dry type cleaning apparatus 1*a*, as plural cleaning tanks 3*a* are continuously moved along the linear guide 35. FIG. 11 is a disassembled perspective view and FIG. 12 is a perspective view of a dry type cleaning apparatus lb according to a third embodiment of the present invention. In the dry type cleaning apparatus 1*b*, the plural cleaning tanks 3*a* are provided along the circumference of a rotating table 42, which is rotated by a table driving unit 43. Plural combinations of the suction openings 26 and the air openings 27 connected to the suction pipes 22 and the air pipes 23 are provided along the circumference of the table driving unit 43, which matches the circumference of the rotating table 42 provided with the cleaning tanks 3*a*. In this case, the suction openings 26 and the air openings 27 are not provided under an inlet 44 from which the cleaning object 2 is inserted.

In this turntable-type dry type cleaning apparatus 1*b*, a sufficient amount of the cleaning medium 11 and the cleaning object 2 are put into the cleaning tank 3*a* from the inlet 44. The rotating table 42 is intermittently rotated by a constant feed angle, so that the cleaning tanks 3*a* are moved to and stopped at positions where the suction openings 26 and the air openings 27 are provided in the table driving unit 43. At these positions, the suction valves 29 and the air valves 30 are opened so that the suction pipes 22 suction air inside the cleaning tanks 3*a*, and compressed air is blown into the cleaning tanks 3*a* from the nozzles 28 of the air pipes 23. Accordingly, high-speed airflows are generated inside the cleaning tanks 3*a*, during which the table driving unit 43 rotates the rotating table 42 back and forth by amplitude corresponding to at least the intervals between the suction openings 26 and the air openings 27. Therefore, high-speed airflows are generated inside the cleaning tanks 3*a*, and the cleaning medium 11 accumulated on the porous members 24 inside the cleaning tanks 3*a* are continuously caused to fly. When one of the cleaning tanks 3*a* rotates once and reaches the inlet 44, the cleaning object 2 in the cleaning tank 3*a* is retrieved and replaced with another cleaning object 2, and the cleaning operation is repeated.

By rotating the cleaning tanks 3*a* around the same circumference, a relatively long cleaning tank moving path can be realized within a small space, and the cleaning objects 2 can be continuously cleaned. Further, the cleaning medium 11 and the cleaning object 2 are put in and retrieved at a single inlet 44, thereby reducing the user's workload.

Figure 13:
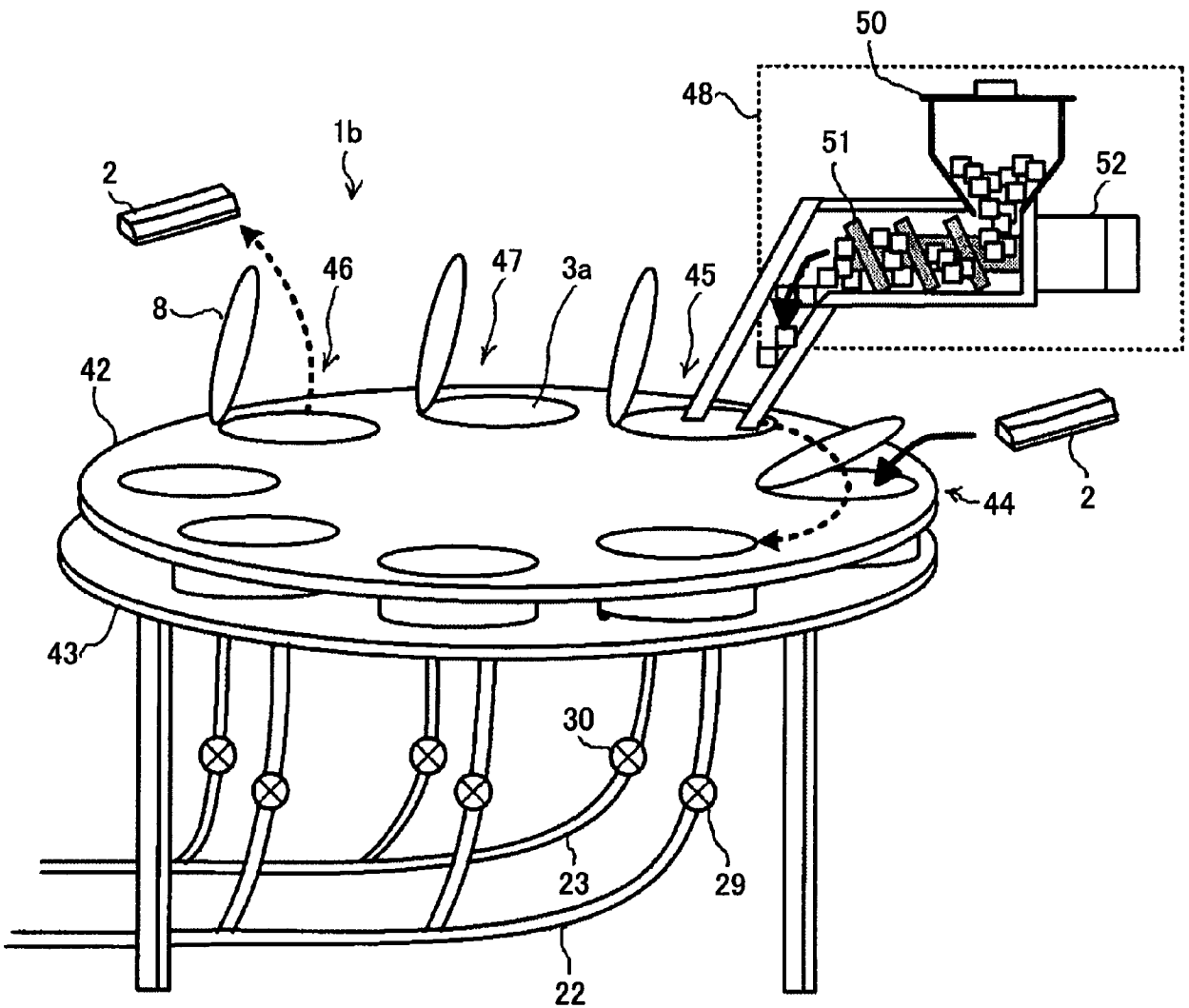
FIG. 13 is a variation of the dry type cleaning apparatus according to the third embodiment.

The cleaning medium 11 wears out as it is continuously used in the dry type cleaning apparatus lb for cleaning the cleaning object 2. As a result, the cleaning medium 11 is discharged by being suctioned or discharged by adhering to the cleaning object 2, such that the cleaning medium 11 eventually decreases in amount. Accordingly, it is necessary to periodically replenish the cleaning medium 11. As shown in a perspective view of the dry type cleaning apparatus 1*b* in FIG. 13, a cleaning medium inlet section 45, a measuring section 46, and a discharge section 47 are provided along the cleaning tank moving path for the cleaning tanks 3*a* of the rotating table 42 on an upstream side of the inlet 44 in the direction of rotation of the rotating table 42. A cleaning medium automatic insertion device 48 is connected to the cleaning medium inlet section 45. As shown in a partial cut-away side view of FIG. 14, the measuring section 46 is provided with a cleaning medium amount measuring unit 49.

Figure 14:
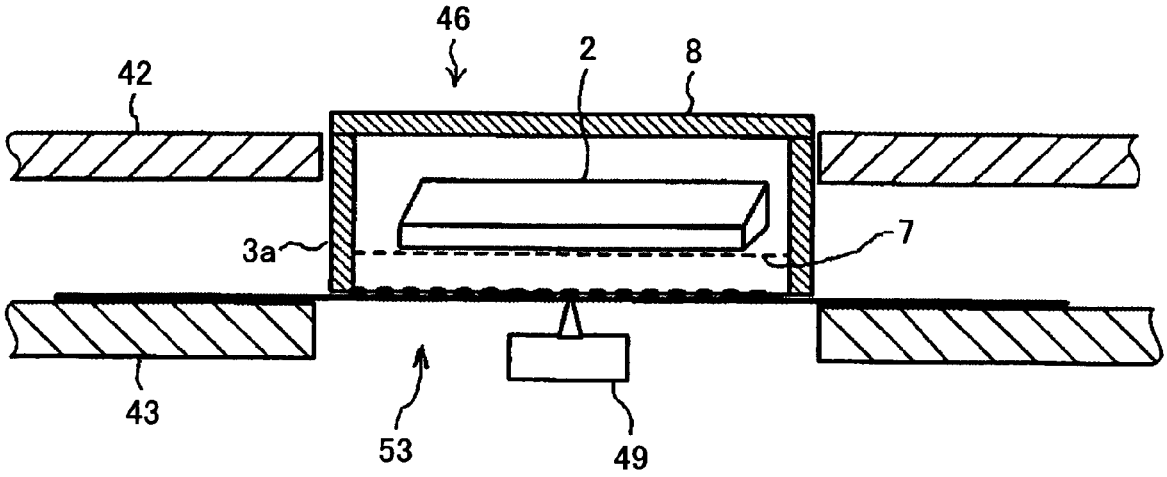
FIG. 14 is a partial cut-away side view of a measuring section including a cleaning medium amount measuring unit.
Figure 15:
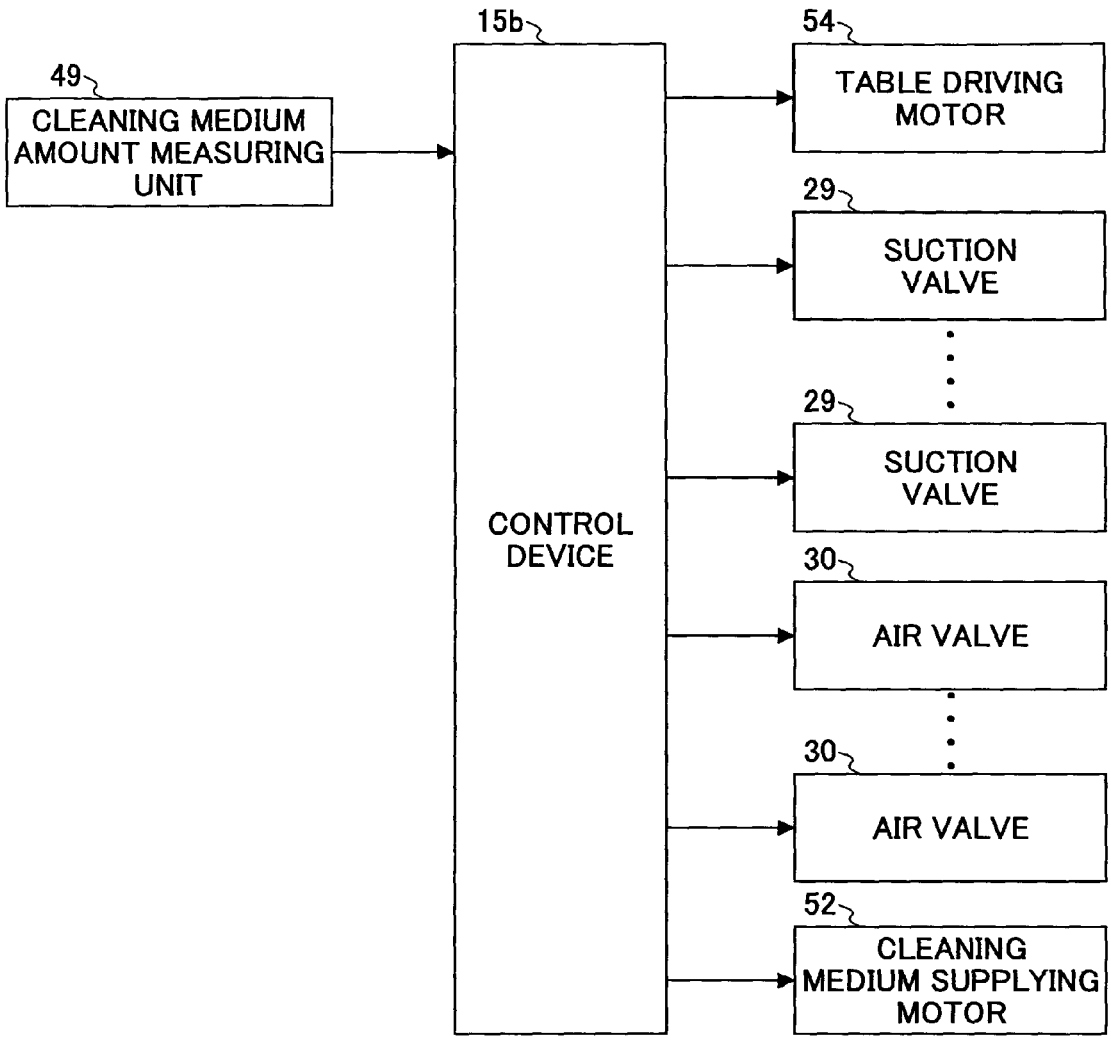
FIG. 15 is a block diagram of a control device and various input/output units according to the third embodiment.

The cleaning medium automatic insertion device 48 includes a hopper 50 for temporarily accumulating the cleaning medium 11, a supplying screw 51, and a cleaning medium supplying motor 52 that drives the supplying screw 51. As shown in FIG. 14, an opening 53 is formed at the position corresponding to the measuring section 46 of the table driving unit 43. The opening 53 is provided with, for example, a weighted sensor functioning as the cleaning medium amount measuring unit 49. As shown in a block diagram of FIG. 15, the cleaning medium amount measuring unit 49 is connected to a control unit 15*b* that controls operations of a table driving motor 54 of the table driving unit 43, the cleaning medium supplying motor 52, the suction valves 29, and the air valves 30.

In the dry type cleaning apparatus 1*b* including the cleaning medium automatic insertion device 48 and the cleaning medium amount measuring unit 49, a certain amount of the cleaning medium 11 is put in the cleaning tank 3*a* from the cleaning medium automatic insertion device 48 at the cleaning medium inlet section 45. When this cleaning tank 3*a* moves to the inlet 44, the cleaning object 2 is inserted in the cleaning tank 3*a* and the rotating table 42 is intermittently rotated at a constant feed angle. Accordingly, the cleaning objects 2 contained in the cleaning tanks 3*a* are cleaned. When the cleaning tank 3*a* rotates once and reaches the discharge section 47, the cleaning object 2 is retrieved from the cleaning tank 3*a*. When this cleaning tank 3*a* moves to the measuring section 46, the cleaning medium amount measuring unit 49 measures the weight of the cleaning tank 3*a* and sends the value to the control unit 15*b*. The control unit 15*b* calculates the amount of cleaning medium 11 remaining in the cleaning tank 3*a* based on the weights of each of the cleaning tanks 3*a* registered in advance and the measurement value received from the cleaning medium amount measuring unit 49. The calculated amount of the remaining cleaning medium 11 and the turnover number of the table driving unit 43 are loaded in a storage device. The control unit 15*b* compares the remaining amount of the cleaning medium 11 and a threshold indicating a prescribed amount of the cleaning medium 11. If the control unit 15*b* finds that the remaining amount is less than or equal to the threshold in one of the cleaning tanks 3*a*, the cleaning medium 11 is replenished as follows. Specifically, when this cleaning tank 3*a* moves to the position of the cleaning medium inlet section 45, the control unit 15*b* drives the cleaning medium automatic insertion device 48 to replenish the cleaning medium 11 in the cleaning tank 3*a*. The control unit 15*b* drives the cleaning medium automatic insertion device 48 such that the remaining amount of the cleaning medium 11 reaches a predetermined standard value. By automating the replenishing operation of the cleaning medium 11, the amount of the cleaning medium 11 in each of the cleaning tanks 3*a* is stabilized. As a result, cleaning quality can be stabilized and the workload of the user can be reduced.

In the above description a weighted sensor is used as the cleaning medium amount measuring unit 49. A photoelectric sensor can be provided in each of the cleaning tanks 3*a* to measure the cleaning medium accumulation amount and/or the number of flying cleaning media in order to obtain the remaining amount of the cleaning medium 11.

In the above description, the cleaning medium automatic insertion device 48 replenishes the cleaning medium 11 according to the remaining amount of cleaning medium 11. However, the cleaning medium automatic insertion device 48 can replenish a prescribed amount of the cleaning medium 11 according to a number of rotations of the cleaning tank 3*a* or a number of times the cleaning medium 11 has been used.

Figure 16:
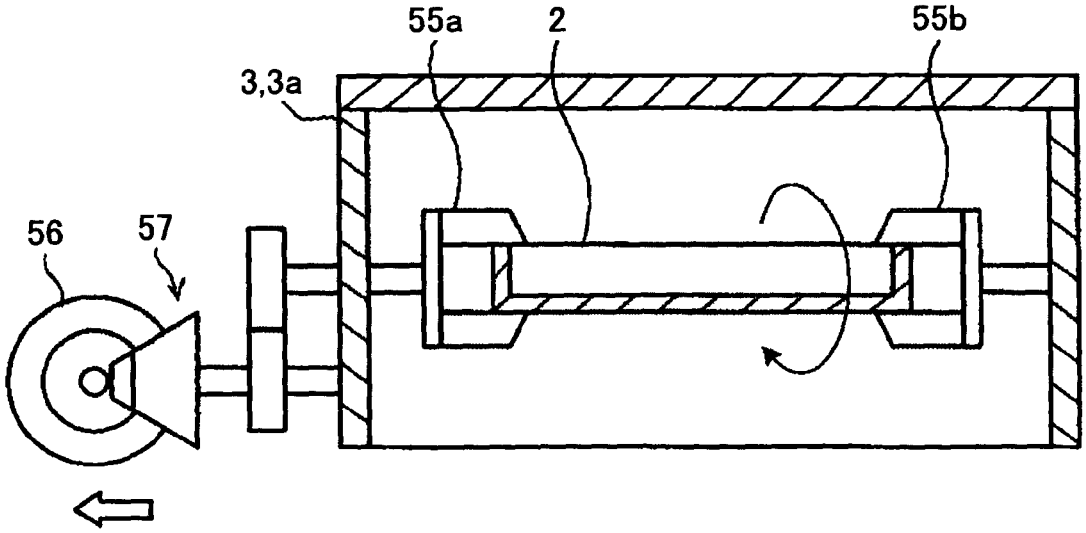
FIG. 16 is a cut-away side view of a cleaning tank provided with cleaning object fixtures.

The cleaning tanks 3, 3*a* of the dry type cleaning apparatus 1, 1*a*, 1*b* employ a wire mesh as the cleaning object fixing unit 7, which has the openings 12 that are large enough for the cleaning medium 11 to pass though. As shown in a cut-away side view of FIG. 16, the cleaning object fixing unit 7 can be configured by cleaning object fixtures 55*a*, 55*b*, a rotating unit 56, and a rotation transmitting unit 57. The cleaning object fixtures 55*a*, 55*b* are rotatable components provided at opposing sides of the cleaning tank body 6 of the cleaning tank 3, and hold the cleaning object 2 by sandwiching the cleaning object 2. The rotating unit 56 is a friction pulley that is caused to rotate by relative movements between the cleaning tank 3 and the cleaning medium flying unit 5 or relative movements between the cleaning tank 3*a* and the linear guide 35 or the table driving unit 43. The rotation transmitting unit 57 is a group of bevel gears that transmits the rotation of the rotating unit 56 to the rotational axis of the cleaning object fixtures 55*a*, 55*b*. All surfaces of the cleaning object 2 can be cleaned at an even higher speed as the cleaning object 2 is rotated (posture of the cleaning object 2 is changed) in association with the oscillation of the separating unit 17 or the movement of the cleaning tank 3*a*, while the cleaning medium 11 is being caused to fly in the cleaning tank 3, or while the separating unit 17 of the cleaning medium flying unit 5 is being oscillated, or while the cleaning tank 3*a* is being moved along the linear guide 35 or the table driving unit 43 while the cleaning medium 11 is flying in the cleaning tank 3*a*.

In the above description, the rotating unit 56 rotates the cleaning object fixtures 55*a*, 55*b* due to relative movements between the cleaning tank 3 and the cleaning medium flying unit 5 or relative movements between the cleaning tank 3*a* and the linear guide 35 or the table driving unit 43. However, the rotational axis of the cleaning object fixtures 55*a*, 55*b* can be caused to rotate by a rotation driving device such as a driving motor.

Figure 17:
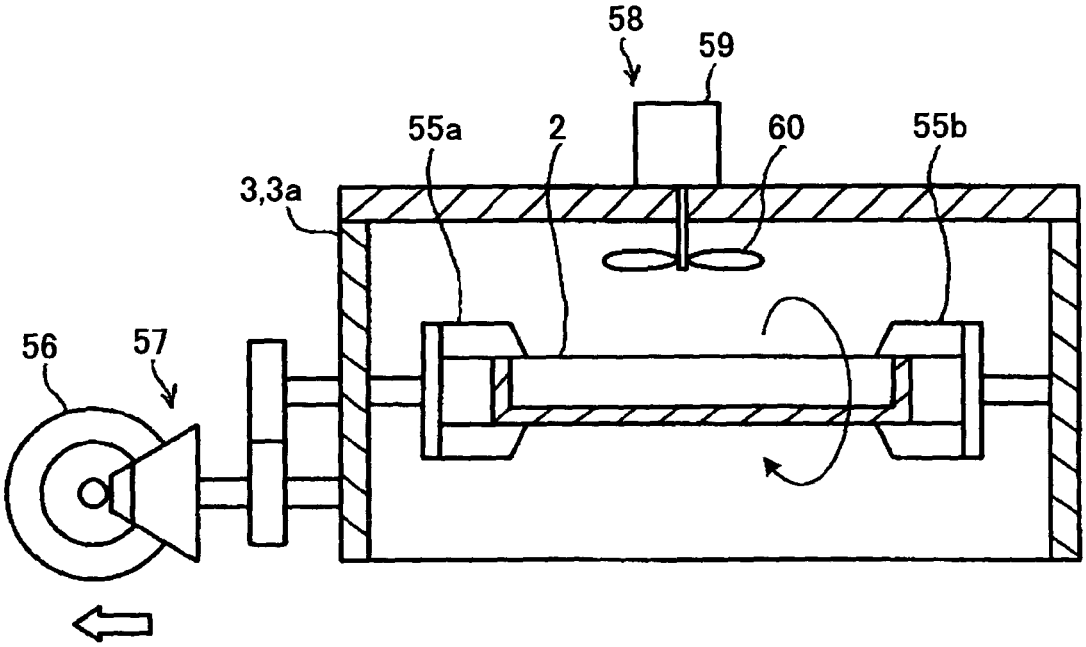
FIG. 17 is a cut-away side view of a cleaning tank provided with a cleaning medium accelerating unit.

Further, as shown in FIG. 17, a cleaning medium accelerating unit 58 can be provided in the cleaning tanks 3, 3*a*, for accelerating the cleaning medium 11 flying in the cleaning tanks 3, 3*a*. As shown in FIG. 17, the cleaning medium accelerating unit 58 can be a cleaning medium accelerating propeller 60 connected to a motor 59 driven by batteries, or an air blowing nozzle connected to a compressed air generating device. The cleaning medium accelerating unit 58 is arranged at a position opposite to the air opening 27, which blows airflows into the cleaning tank 3, 3*a*, across the cleaning object 2. By arranging the cleaning medium accelerating unit 58 at a position opposite to the air opening 27, which blows airflows into the cleaning tank 3, 3*a*, across the cleaning object 2, the cleaning medium 11 accelerated by the airflow blown in from the air opening 27 and the cleaning medium 11 accelerated by the airflow from the cleaning medium accelerating unit 58 collide with the cleaning object 2 to remove dirt, so that all surfaces of the cleaning object 2 are uniformly cleaned.

In the above description, the cleaning medium accelerating unit 58 is arranged at a position opposite to the air opening 27, which blows airflows into the cleaning tank 3, 3*a*, across the cleaning object 2. However, the cleaning medium accelerating unit 58 can be arranged at a position where the airflow blown out from the air opening 27 is accelerated, thereby accelerating the cleaning medium 11 even further, so that persistent dirt can be quickly removed.

By using the cleaning medium accelerating propeller 60 connected to the motor 59 driven by batteries, the cleaning tank 3, 3*a* can be moved smoothly without being obstructed by wires from a power source.

Figure 18A:
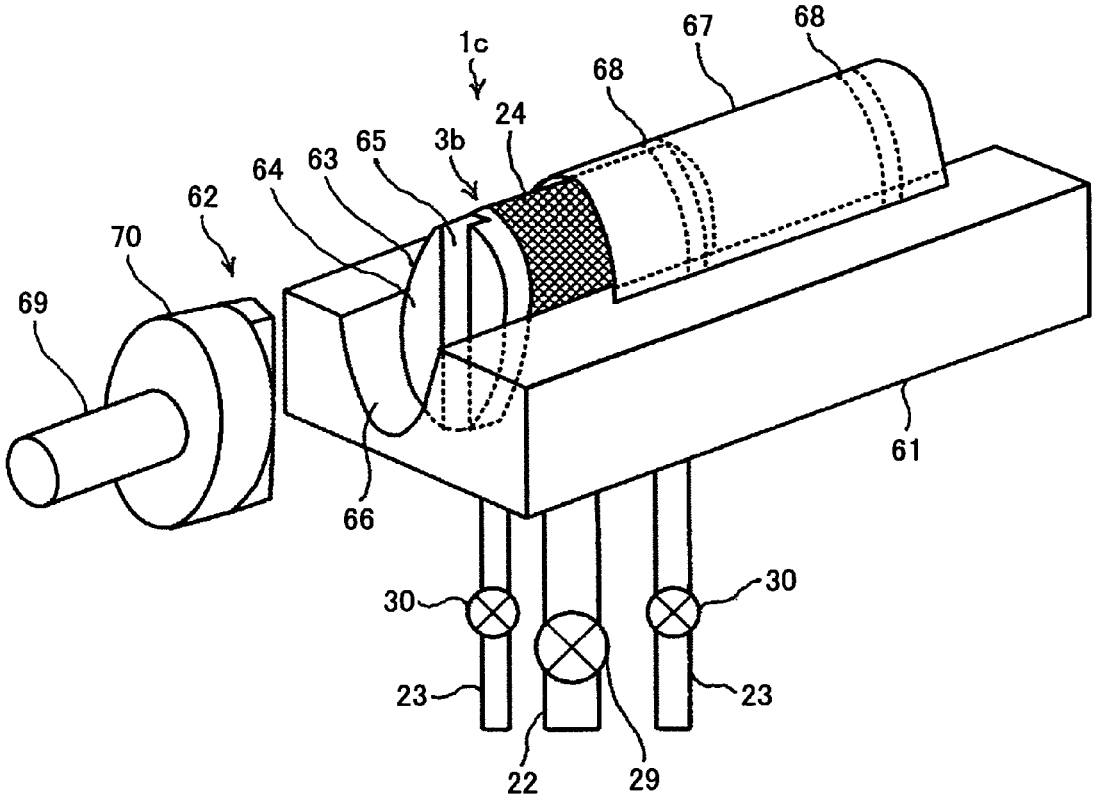
FIG. 18A is a dry type cleaning apparatus according to a fourth embodiment of the present invention.

Another dry type cleaning apparatus is described next. FIG. 18A is a perspective view of a dry type cleaning apparatus 1*c* according to a fourth embodiment of the present invention. The dry type cleaning apparatus 1*c* includes a cleaning tank 3*b*, a slide guide 61, the suction pipe 22 and the air pipes 23 connected to the slide guide 61, and a cleaning tank driving unit 62.

The cleaning tank 3*b* has a cylindrical shape having a certain length. Except for edges 63 on both sides of the cleaning tank 3*b*, the outer periphery is covered by the porous member 24 having many small holes and slits through which gas and dust can pass but the cleaning medium 11 cannot pass. Inside the cleaning tank 3*b* is provided a bag-shaped cleaning object fixing unit 7 having the plural openings 12 large enough to allow the cleaning medium 11 to pass through. Both of the edges 63 of the cleaning tank 3*b* have lids 64 that can open and close. Each of the lids 64 has a connecting part 65 including a groove and processes that engage the cleaning tank driving unit 62.

Figure 18B:
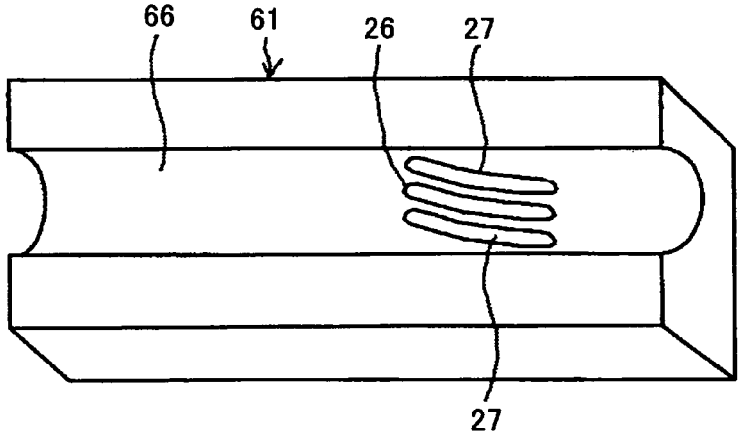
FIG. 18B is a perspective view of a slide guide shown in FIG. 18A.

The slide guide 61 includes a semi-cylindrical guide groove 66 and a semi-cylindrical cover 67 covering all or part of the guide groove 66. As shown in the perspective view of FIG. 18B, in the guide groove 66, the suction opening 26 and the air openings 27 are alternately provided at predetermined positions in the forms of curved grooves. Inside the cover 67, corresponding to positions of the suction opening 26 and the air openings 27, seal members 68 for sealing both edges 63 of the cleaning tank 3*b* are provided. One end of the suction pipe 22 including the suction valve 29 is connected to the suction opening 26 of the slide guide 61, while the other end is connected to a suction device such as a blower. Each of the air pipes 23 including the air valves 30 is covered with the nozzle 28 at one end, and the nozzles 28 are connected to the air openings 27 of the slide guide 61. The other ends of the air pipes 23 are connected with a compressed air supplying device.

The cleaning tank driving unit 62 includes a cleaning tank feed unit 69, a rotating motor provided at the edge of the cleaning tank feeding unit 69, and a cleaning tank rotating unit 70 including a rotating motor and a rotation transmitting unit that engages the connecting part 65 of the lid 64 of the cleaning tank 3*b*, and transmits rotation to the cleaning tank 3*b*. The cleaning tank feed unit 69 is configured by, for example, an air cylinder, a feed motor, and a feed screw mechanism.

When cleaning the cleaning object 2 with the dry type cleaning apparatus 1*c*, the lid 64 of the cleaning tank 3*b* is opened outside the slide guide 61, the cleaning object 2 and the cleaning medium 11 are put in the cleaning tank 3*b*, and the cleaning object 2 is fixed to the bag-shaped cleaning object fixing unit 7. Then, the lid 64 of the cleaning tank 3*b* is closed, and as shown in FIG. 18A, the cleaning tank 3*b* is loaded from an inlet of the slide guide 61. Next, the cleaning tank driving unit 62 engages the connecting part 65 of the lid 64 of the cleaning tank 3*b*, and the cleaning tank 3*b* is pushed forward to a predetermined position of the slide guide 61 where the suction opening 26 and the air openings 27 are provided. When the cleaning tank 3*b* is pushed forward to the predetermined position, the cleaning tank 3*b* is stopped and then rotated. When the cleaning tank 3*b* is rotating, the suction valve 29 and the air valves 30 are opened so that the suction pipes 22 suction air inside the cleaning tank 3*b*, and compressed air is blown into the cleaning tank 3*b* from the nozzles 28 of the air pipes 23. Accordingly, high-speed airflows are generated inside the cleaning tank 3*b*, which cause the cleaning medium 11 to fly and collide with the cleaning object 2, thereby cleaning the cleaning object 2. While cleaning the cleaning object 2, the cleaning medium 11 flies and rotates in synchronization with the rotation of the cleaning tank 3*b*. Therefore, it is ensured that the cleaning medium 11 collides with all surfaces of the cleaning object 2, so that the cleaning medium 11 uniformly cleans all surfaces of the cleaning object 2. After the cleaning process is performed for a predetermined amount of time, the suction valve 29 and the air valves 30 are closed, the rotation of the cleaning tank 3*b* is stopped, and the cleaning tank 3*b* is sent out through a discharge outlet of the slide guide 61. Then, the next cleaning tank 3*b* is inserted and the cleaning process is performed. The cleaning medium 11 is caused to flow by rotating the cleaning tank 3*b* so that all surfaces of the cleaning object 2 are uniformly cleaned, while preventing the porous member 24 being clogged.

According to one embodiment of the present invention, dust and granular material adhering to a cleaning object is removed with a cleaning medium caused to flow by a high-speed airflow. A porous member is provided to separate the removed dust and granular material from the cleaning medium. An area on the porous member where the separated dust and granular material are suctioned and an area on the porous member that receives an airflow for causing the cleaning medium to flow can be changed. The cleaning medium separated from the dust and granular material and accumulated onto the porous member is caused to fly again by an airflow. Accordingly, the porous member is prevented from being clogged by the cleaning medium and the cleaning medium can be continuously caused to fly, thereby enhancing cleaning efficiency.

Further, according to one embodiment of the present invention, one or plural cleaning medium flying units are provided with predetermined intervals beneath a cleaning tank moving unit that moves cleaning tanks. While the cleaning tank moving unit is moving the cleaning tanks, the cleaning medium flying units cause cleaning medium inside the cleaning tanks to flow. Accordingly, it is possible to continuously load cleaning tanks, and cleaning objects contained in the cleaning tanks can be continuously cleaned.

Further, according to one embodiment of the present invention, it is possible to easily generate in the cleaning tank the airflow necessary for causing the cleaning medium to fly, and cleaning objects contained in plural cleaning tanks can be simultaneously cleaned, thereby further enhancing cleaning efficiency.

Further, according to one embodiment of the present invention, the cleaning object contained in the cleaning tank can be continuously cleaned while preventing the porous member in the cleaning tank from being clogged, thereby enhancing cleaning efficiency.

Further, according to one embodiment of the present invention, plural cleaning tanks can be continuously loaded with a simple structure so that many cleaning objects can be efficiently cleaned.

Further, according to one embodiment of the present invention, plural cleaning tanks can be continuously loaded and a relatively long cleaning tank moving path can be realized within a small space, so that cleaning objects can be continuously cleaned. The cleaning medium and the cleaning object are loaded and retrieved at a single inlet, thereby reducing the user's load.

Further, according to one embodiment of the present invention, the porous member of the cleaning tank is surely prevented from being clogged.

Further, according to one embodiment of the present invention, the cleaning medium collides with the cleaning object overall, so that a large area of the cleaning object is cleaned, thereby enhancing cleaning efficiency.

Further, according to one embodiment of the present invention, the cleaning medium can be caused to fly from an obliquely lower direction against the cleaning object, so that the cleaning medium easily collides with the side surfaces of the cleaning object, and the cleaning medium alternately collides with the cleaning object from left and right sides, thereby enhancing cleaning efficiency in cleaning all surfaces of a cleaning object that is thick in three dimensions.

Further, according to one embodiment of the present invention, all surfaces of the cleaning object can be efficiently cleaned with a posture changing unit. The posture changing unit is caused to operate by movements of the cleaning tank, and thus does not require special driving means.

Further, according to one embodiment of the present invention, the cleaning medium can be thoroughly separated-from the cleaning object.

Further, according to one embodiment of the present invention, the cleaning medium accelerated by airflows of different angles and different patterns is caused to collide with the cleaning object inside the cleaning tank, so that even a three-dimensional cleaning object can be uniformly cleaned.

Further, according to one embodiment of the present invention, the cleaning object can be cleaned even more efficiently, and all surfaces of the cleaning object can be uniformly cleaned.

Further, according to one embodiment of the present invention, the cleaning medium in the cleaning tank can be easily replenished.

Further, according to one embodiment of the present invention, the consumption amount of the cleaning medium can be surely detected.

Further, according to one embodiment of the present invention, the cleaning medium in the cleaning tank can be automatically replenished and the amount of cleaning medium in the cleaning tank can be appropriately maintained, so that the cleaning objects can be consistently and thoroughly cleaned.

Further, according to one embodiment of the present invention, all surfaces of the cleaning object can be uniformly cleaned while preventing the porous member in the cleaning tank being clogged.

Further, according to one embodiment of the present invention, unnecessary compressed air and unnecessary suction can be eliminated, which leads to energy savings.

The present invention is not limited to the specifically disclosed embodiments, and variations and modifications may be made without departing from the scope of the present invention.

The present application is based on Japanese Priority Patent Application No. 2005-319204, filed on Nov. 2, 2005 and Japanese Priority Patent Application No. 2006-258191, filed on Sep. 25, 2006, the entire contents of which are hereby incorporated by reference.

What is claimed is:

1. A cleaning apparatus for removing dust adhering to a cleaning object, with the use of a flake-shaped cleaning medium caused to flow by an airflow and collide with the cleaning object, the cleaning apparatus comprising:

a cleaning tank having an opening at a bottom part of the cleaning tank;

a flake-shaped cleaning medium disposed in the cleaning tank for removing dust adhering to the cleaning object by colliding with the cleaning object;

a separating member provided at the opening, configured to separate the removed dust adhering to the cleaning medium after the cleaning medium has collided with the cleaning object;

an air blowing unit configured to blow out air into the cleaning tank through the separating member to cause the cleaning medium to flow;

an air suction unit configured to suction air from the cleaning tank through the separating member; and a relative moving unit configured to move the air blowing unit and the separating member relatively to each other, and to move the air suction unit and the separating member relatively to each other, so that an area on the separating member is switched from an area where air is blown into the cleaning tank to an area where air in the cleaning tank is suctioned.

2. The cleaning apparatus according to claim 1, wherein:

the separating member includes a porous member provided at the bottom part of the cleaning tank, the porous member including holes through which the dust can pass but the cleaning medium cannot pass.

3. The cleaning apparatus according to claim 1, further comprising:

a cleaning tank guiding unit configured to guide movement of the cleaning tank, wherein:

a plurality of the air blowing units and a plurality of the air suction units are arranged along a direction in which the cleaning tank moves.

4. The cleaning apparatus according to claim 2, further comprising:

a cleaning tank guiding unit configured to guide movement of the cleaning tank, wherein:

a plurality of the air blowing units and a plurality of the air suction units are arranged along a direction in which the cleaning tank moves.

5. The cleaning apparatus according to claim 1, wherein:

a plurality of different air blowing units are provided, which blow out air into the cleaning tank at different angles or by different patterns.

6. The cleaning apparatus according to claim 1, further comprising:

a cleaning medium insertion unit configured to put the cleaning medium in the cleaning tank; and a cleaning medium measuring unit configured to measure the amount of the cleaning medium in the cleaning tank after the cleaning object is cleaned, wherein:

the amount of the cleaning medium put in the cleaning tank by the cleaning medium insertion unit is controlled in accordance with the amount of the cleaning medium measured by the cleaning medium measuring unit.

* * * * *